US006353280B1

(12) United States Patent
Shibata et al.

(10) Patent No.: US 6,353,280 B1
(45) Date of Patent: Mar. 5, 2002

(54) SPACER FOR IMAGE-FORMING APPARATUS

(75) Inventors: Masaaki Shibata, Ninomiya-machi; Sotomitsu Ikeda, Atsugi; Toyoko Kobayashi, Kawasaki; Masato Yamanobe, Machida, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/339,933

(22) Filed: Jun. 25, 1999

Related U.S. Application Data

(62) Division of application No. 08/998,082, filed on Dec. 24, 1997, now Pat. No. 6,153,973.

(30) Foreign Application Priority Data

Dec. 26, 1996 (JP) ..... 8-347635
Apr. 7, 1997 (JP) ..... 9-088518
Jun. 16, 1997 (JP) ..... 9-158472

(51) Int. Cl.[7] ..... H07J 19/42
(52) U.S. Cl. ..... 313/292; 313/495; 313/422
(58) Field of Search ..... 313/292, 495, 313/496, 258, 497, 422

(56) References Cited

U.S. PATENT DOCUMENTS 3,729,575 A * 4/1973 Harding et al. ..... 313/292
5,063,327 A 11/1991 Brodie et al. ..... 313/482
5,371,433 A 12/1994 Horne et al. ..... 313/495
5,543,684 A 8/1996 Kumar et al. ..... 313/495
5,598,056 A * 1/1997 Jin et al. ..... 313/495
5,637,957 A * 6/1997 Konishi et al. ..... 313/495
5,663,608 A * 9/1997 Jones et al. ..... 313/309
5,704,820 A * 1/1998 Chandross et al. ..... 445/24
5,939,822 A * 8/1999 Alderson ..... 313/495

FOREIGN PATENT DOCUMENTS

| | | |
|---|---|---|
| EP | 0 580 244 A1 | 1/1994 |
| EP | 739 029 A2 | 10/1996 |
| JP | 5-266807 | 10/1993 |
| JP | 6-162968 | 6/1994 |
| JP | 7-45221 | 2/1995 |
| JP | 7-99679 | 10/1995 |
| JP | 8-180821 | 7/1996 |
| JP | 8-241667 | 9/1996 |
| JP | 8-241670 | 9/1996 |
| JP | 8-250032 | 9/1996 |
| JP | 8-315726 | 11/1996 |
| JP | 9-22649 | 1/1997 |
| WO | WO 90-00808 | 1/1990 |
| WO | WO 94-18694 | 8/1994 |

* cited by examiner

*Primary Examiner*—Michael H. Day
*Assistant Examiner*—Joseph Williams
(74) *Attorney, Agent, or Firm*—Fitzpatrick, Cella, Harper & Scinto

(57) ABSTRACT

An image-forming apparatus comprises a rear plate on which an electron-emitting device is provided, a face plate having an image-forming member and arranged to be opposed to the rear plate, and a spacer provided between the face plate and the rear plate. The spacer comprises a spacer base plate and a coating layer including organic resin and carbon. At least part of the carbon is exposed from the surface of the coating layer. The image-forming apparatus displays an image with a high luminance and a high color saturation over a prolonged time.

8 Claims, 16 Drawing Sheets

PRIOR ART FIG. 15
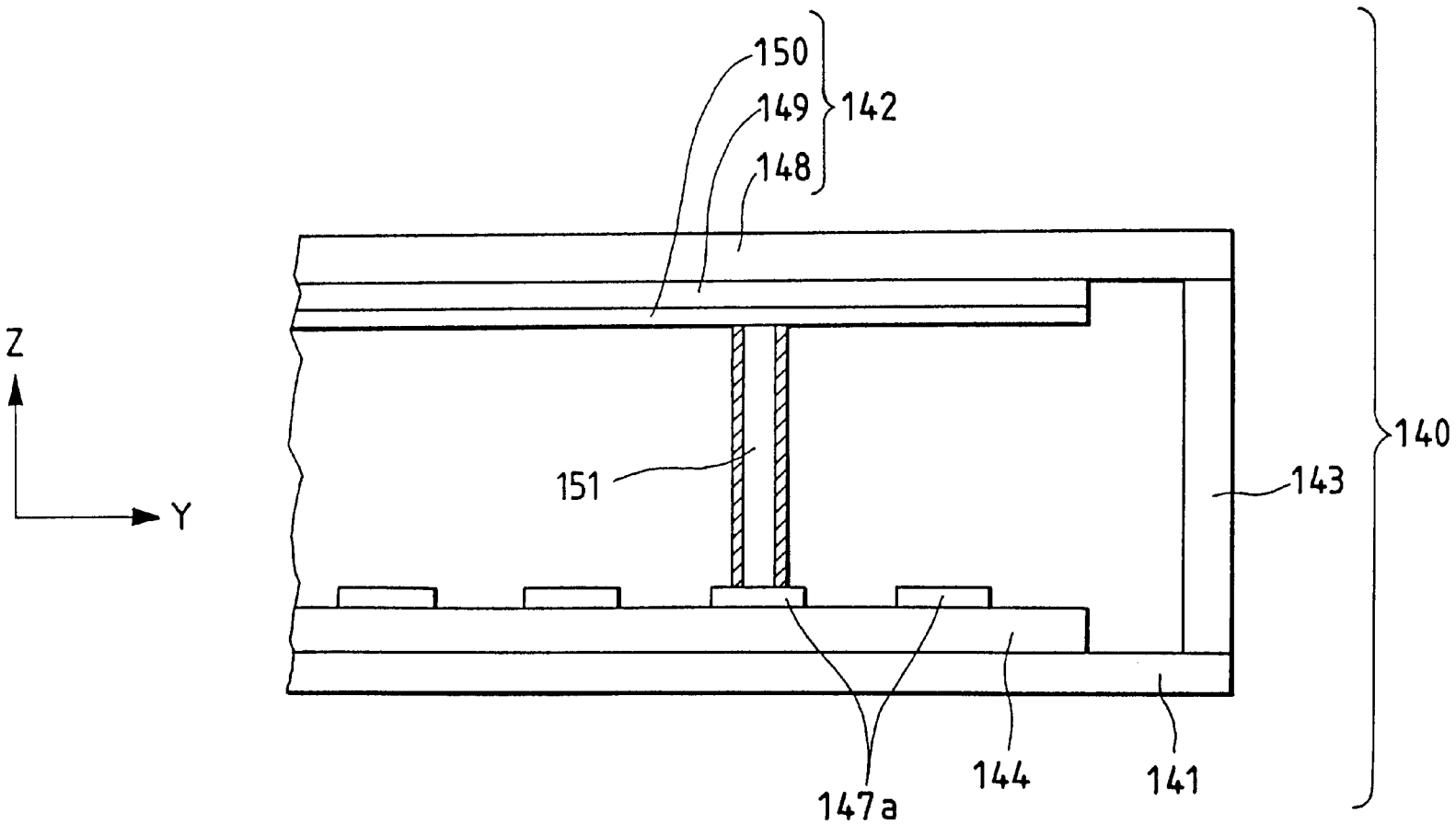

SPACER FOR IMAGE-FORMING APPARATUS

This is a divisional application of application Ser. No. 08/998,082, filed Dec. 24, 1997, now U.S. Pat. No. 6,153, 973.

BACKGROUND OF THE INVENTION

1. Field of the Invention

The present invention relates to a spacer provided in a container including an electron-emitting device, an image-forming apparatus comprising an electron-emitting device, an image-forming member, and a spacer, in a container, and a manufacturing method thereof.

2. Related Background Art

As an image-forming apparatus using an electron-emitting device, an electron beam display panel of a flat type has been conventionally known in which an electron source substrate on which a number of cold cathode electron emitting devices are formed is opposed in parallel to an anode substrate comprising a transparent electrode and a fluorescent member and which is exhausted to be in a vacuum.

Among image-forming apparatuses of this kind, an image-forming apparatus using a field emission electron-emitting device is, for example, disclosed in I. Brodie, "Advanced technology: flat cold-cathode CRTs", Information Display, 1/89, 17(1989). Another image-forming apparatus using a surface conduction electron-emitting device is, for example, disclosed in Japanese Patent Application Laid-open No. 7-45221.

An electron beam display panel of a flat surface type can realize a lighter weight and a larger screen in comparison with a cathode ray tube (CRT) display apparatus which is widely used at present, and can provide an image with a higher luminance and a higher quality in comparison with a flat type display panel including, for example, a plasma display or a liquid crystal display.

FIGS. 14 and 15 are views schematically showing a structure of a conventional flat type electron beam display panel, as an example of an image-forming apparatus using an electron-emitting device. See Japanese Patent Application Laid-open No. 8-180821. FIG. 15 is a cross-section cut along line 15—15 in FIG. 14.

The structure of the conventional flat type electron beam display panel shown in FIGS. 14 and 15 will now be explained in details below. In these figures, reference 141 denotes a rear plate on which an electron source substrate 144 is provided, and reference 142 denotes a face plate as an anode substrate. These substrates are connected with each other and also with a supporting frame (or outer frame) 143 by a connecting portion made of frit glass or the like, thereby forming a vacuum envelope. Reference 145 denotes an electron-emitting element. Reference 146*a* (e.g., a scanning electrode) and reference 146*b* (e.g., a signal electrode) are electrode wires and are connected to the electron-emitting device 145. References 147*a* and 147*b* denote a scanning line and a signal line, respectively. Reference 148 is a glass substrate as a base member of the face plate. Reference 149 denotes a fluorescent member, and reference 150 denotes a metal back. Reference 151 is a spacer which maintains the rear plate 141 and the face plate 142 with a predetermined distance inserted therebetween, and is provided as a support member against an air pressure.

To form an image by the electron beam display panel, scanning lines 147*a* and signal lines 147*b* arranged in a matrix are sequentially applied with a predetermined voltage, to selectively drive predetermined electron-emitting devices 145 positioned at cross points of the matrix. Electrons emitted therefrom are irradiated onto a fluorescent member 149 to obtain a luminance point at a predetermined position. Note that a metal back (anode) 150 is applied with a high electric potential such that a positive potential is obtained with respect to devices 145, in order to accelerate emitted electrons to obtain a luminance point with a higher luminance.

The image-forming apparatus constructed in the structure as described above, particularly, uses a fluorescent member of a low price having a high light-emission efficiency, which is used in a current CRT display, and an acceleration voltage of several kV to several tens kV is applied to obtain a high luminance and to improve color performance. However, a distance d between the rear plate 141 and the face plate 142 must be set to 1 mm or more in consideration of an insulating break-down in a vacuum (i.e., a discharge).

Meanwhile, in the case of using a field emission electron-emitting device as an electron-emitting device as described above, a convergence electrode may be provided or the distance d between the rear plate 141 and the face plate 142 may be reduced, to form an image, in response to a problem of convergence of an electron beam. The voltage applied in this case falls within a range from several hundreds V to several kV although the voltage depends on the performance of a fluorescent member, the presence or absence of a metal back, and the distance between the face plate and the rear place. Therefore, the distance d between the rear plate 141 and the face plate 142 (or the distance between the wire 147*b* and the metal back 150, more specifically) is generally set to one hundred $\mu$m to several mm, so that a insulating break-down in a vacuum (i.e., a discharge) might not take place.

In order to reduce deformation of substrates caused by a pressure difference between the vacuum inside an envelope and the external air pressure, the rear plate substrate 141 and the face plate substrate 148 must be thickened as the display area of a display panel increases. An increase in thickness of the substrates causes an increase in weight of the display panel and deformation viewed from an oblique direction. Therefore, by providing a spacer 151, loads to the strength of the substrates 141 and 148 can be reduced, and a weight reduction, a low cost, and a large screen can be achieved, so that advantage of a flat type electron beam display panel can be sufficiently performed.

Material used for the spacer 151 requires the following conditions. A sufficient air pressure strength (or compressive strength) is ensured and a high aspect ratio (i.e., the ratio between the height of the spacer and the cross-sectional area) is obtained so that the spacer can be arranged in an image-forming apparatus, i.e., the material is strong against a break-down, deformation, and bending caused by compression; the material has a heat resistance enough to withstand heating steps in manufacturing steps and high-vacuum formation steps and matches with heat expansion coefficients of the substrates of the display panel, a supporting frame, and the like; the material is highly resistive material or insulating material having a dielectric strength enough to withstand an application of a high voltage; the material has a low gas discharge rate to maintain a high vacuum; and the material can be processed with high size precision and ensures a high mass-productivity. Generally, glass material is used.

On the other hand, spacers which are improved in creeping discharge breakdown voltage by forming irregularity on their surfaces are exemplarily described in Japanese Patent Application Nos. 8-241667, 8-241670 and 8-315726. It is also described that secondary electrons emitted by incident electron beams to such spacers can be captured by a concave surface to further improve the creeping discharge breakdown voltage and that such spacers are manufactured by molding glass, ceramic or polymer materials.

Glass material generally used has relatively excellent mechanical strength, heat characteristics, and disorption gas characteristics. In addition, such glass material has an excellent process ability and an excellent mass-productivity and is therefore generally used as spacer material.

Meanwhile, there is a case in which some electrons emitted from an electron-emitting device enter into the surface of a spacer. As a result, the spacer surface is charged and greatly reduces the creeping discharge breakdown voltage or the potential of the surface changes and distorts the electric field in the vicinity of the surface, so that courses of electrons from the electron source are adversely affected, resulting in a phenomenon such as a color dislocation which degrades the image quality.

As for a method of avoiding degradation of the quality of images such as a color dislocation caused by a charged spacer as described above, for example, Japanese Patent Publication No. 7-99679 discloses a method of forming a spacer from conductive material having a high resistance which allows a slight current to flow. An apparatus disclosed in this publication comprises a group of electrodes between a face plate and an electron source. These electrodes are convergence electrodes and deflection electrodes for purposes of focusing of electron beams and deflection thereof and are applied with a potential in accordance with those purposes.

Another example of an image-forming apparatus which does not have such a group of electrodes is disclosed in Japanese Patent Application Laid-Open No. 5-266807. In this application, electrodes, wires, and anode electrodes on an electron source substrate on which a plurality of electron-emitting devices are arranged are connected with a spacer member having an electric conductivity, to prevent charging.

Meanwhile, a spacer made of resin or the like such as polyimide is known, other than spacers made of inorganic material such as glass or the like. For example, "Advanced technology: flat cold-cathode CRTs" (Information Display 1/89, pages 17 to 19 and U.S. Pat. No. 5,063,327, Mr. Ivor Brodie discloses a spacer using polyimide. This is a technique in which photosensitive polyimide is applied to a substrate by a spin method and vacuum baking is carried out through a photolithography step (including mask exposure, development, and washing) after pre-baking. Finally, a polyimide spacer having a height of 100 $\mu$m is formed on the surface of a substrate. Further, U.S. Pat. No. 5,371,433 may be cited as an example using photosensitive polyimide. This U.S. Pat. No. 5,371,433 realizes a spacer having a height of about 1 mm by layering two layers of polyimide each having a height of 500 $\mu$m and formed through a photolithography step (including mask exposure, development, and washing), likewise.

Japanese Patent Application Laid-Open No. 6-162968 discloses, for example, a method of coating low secondary electron-emitting material or the like in order to avoid emission of electrons from the inner wall of a spacer plate provided between an address system and a fluorescent screen, in a flat panel type image-forming apparatus in which secondary electrons generated in a plurality of ducts are picked up by an address system and are made to collide into a fluorescent screen.

SUMMARY OF THE INVENTION

The present invention has been made in view of the prior art described above, and has an object of providing an apparatus such as an image-forming apparatus comprising a container including an electron-emitting device, and a spacer which has a high aspect ratio and can be applied with a high voltage, as a spacer to be provided in the container.

Another object of the present invention is to provide a spacer as described above, which has a high creeping resistance.

Another object of the present invention is to provide a spacer as described above, in which a charging effect is restricted.

Another object of the present invention is to provide an image-forming apparatus capable of forming a high quality image having a high luminance and a high color purity.

Another object of the present invention is to provide a stable image-forming apparatus which is difficult to cause charging.

Another object of the present invention is to provide an image-forming apparatus which is provided with a spacer as described above.

According to an aspect of the present invention, there is provided an image-forming apparatus comprising a rear plate on which an electron-emitting device is provided a face plate having an image-forming member and arranged to be opposed to the rear plate, and a spacer provided between the face plate and the rear plate, characterized in that the spacer is formed by covering a spacer base material with organic resin and carbon, and the spacer has a surface including the carbon.

According to another aspect of the present invention, there is provided an image-forming apparatus comprising a rear plate on which an electron-emitting device is provided, a face plate having an image-forming member and arranged to be opposed to the rear plate, and a spacer provided between the face plate and the rear plate, characterized in that the spacer is formed by covering a spacer base material with organic resin, and the spacer base material is formed by dispersing at least one fibrous filler selected from glass, alumina, boron, carbon, and ceramics-based whiskers, in organic resin.

According to still another aspect of the present invention, there is provided an image-forming apparatus comprising a rear plate on which an electron-emitting device is provided a face plate having an image-forming member and arranged to be opposed to the rear plate, and a spacer provided between-the face plate and the rear plate, characterized in that the spacer is formed by covering a spacer base material with organic resin, and the organic resin is polybenzimidazole resin.

According to a further aspect of the present invention, there is provided a method of manufacturing a spacer for an image-forming apparatus described above, characterized by comprising a step of applying organic resin to the spacer base material.

According to a still further aspect of the present invention, there is provided a method of manufacturing a spacer for an image-forming apparatus described above, characterized by including a step of bringing the spacer into contact with an anode formed on the face plate and/or a drive wire formed on the rear plate.

BRIEF DESCRIPTION OF THE DRAWINGS

FIG. 15 is a view explaining a conventional image-forming apparatus;

DESCRIPTION OF THE PREFERRED EMBODIMENTS

Figure 1:
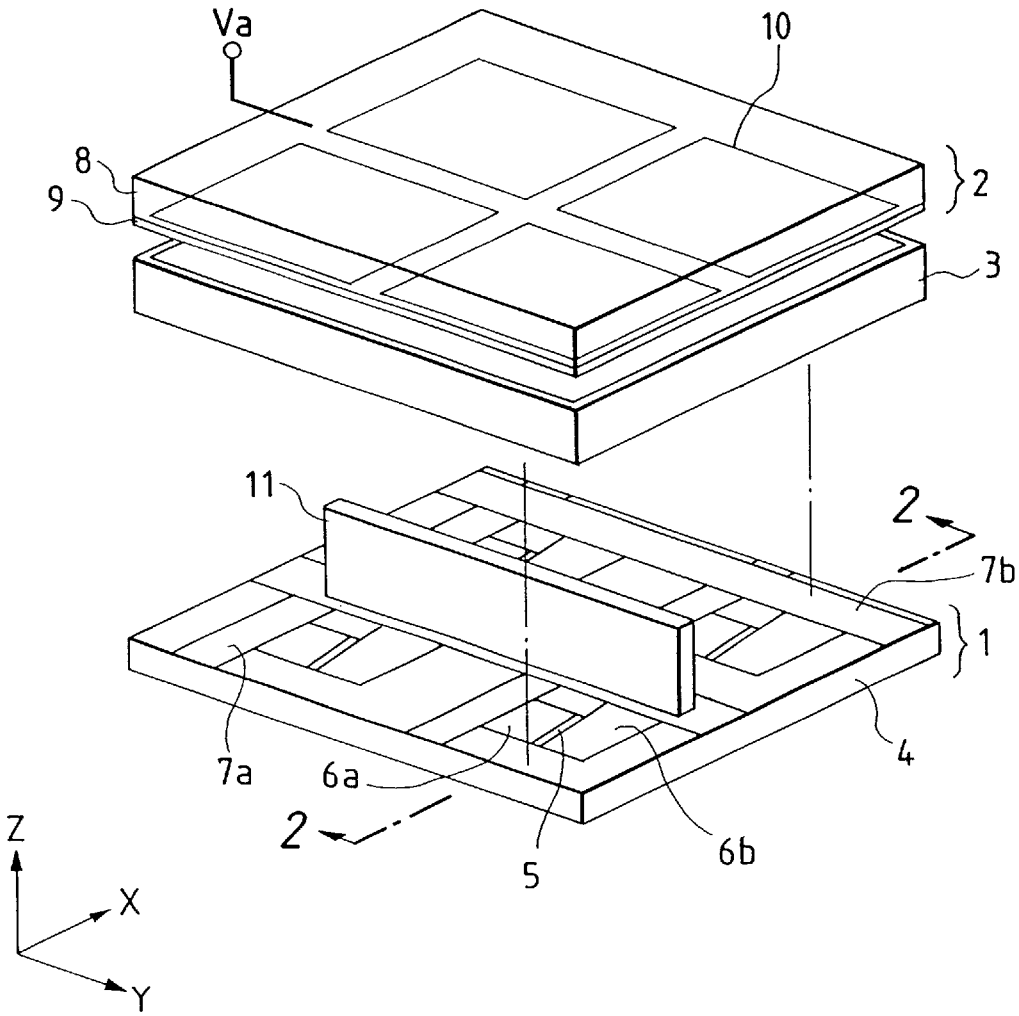
FIG. 1 is a schematic structural view showing an example of an image-forming apparatus according to the present invention.

In a preferred embodiment of the present invention, the spacer described below is used as a spacer for an image-forming apparatus using an electron device. However, in order to achieve the same objects as described above, the same advantages as described above can be attained by adopting the spacer in an apparatus including an electron-emitting device in a container, like the image-forming apparatus.

At first, the present inventors made studies and discussions about the prior art and obtained the knowledge as follows, particularly, with respect to conventional spacer material and an image-forming apparatus provided with a spacer.

(1) In an image-forming apparatus having a spacer made of glass, a creeping discharge withstand voltage is insufficient, and therefore, the height of a spacer must be increased.

As has been described above, a spacer made of glass satisfies the conditions: a sufficient air pressure strength (or compressive strength) is ensured and a high aspect ratio (i.e., the ratio between the height of the spacer and the cross-sectional area), is obtained so that the spacer can be arranged in an image-forming apparatus, i.e., the material is strong against a break-down, deformation, and bending caused by compression; the material has a heat resistance enough to withstand heating steps in manufacturing steps and high-vacuum formation steps and matches with heat expansion coefficients of the substrates of the display panel, a support frame, and the like; the material has a low gas discharge rate to maintain a high vacuum; and the material can be processed with high size precision and ensures a high mass-productivity. However, as for the dielectric resistance, the creeping withstand voltage is only about 3 kV/mm, so that the spacer cannot be applied with a very strong electric field. For example, in case of using a fluorescent member for a CRT with an acceleration voltage of 10 kV, the height of a spacer must be 4 mm or more in consideration of a margin for the creeping discharge withstand voltage, where general glass material is used. In case of using a field-emission electron-emitting device as described above, convergence of electron beams is degraded so that a high definition image cannot be formed where the distance d between a rear plate 141 and a face plate 142 is large.

(2) In an image-forming apparatus using a spacer made of organic resin, the mechanical strength is insufficient and it is therefore difficult to apply a sufficient pressure to a fluorescent member.

Specifically, in case of using resin such as polyimide or the like, the aspect ratio of a spacer (or the ratio between the height and the cross-sectional area of the spacer) is about 5 to 10 times at most, e.g., the spacer has a height of about 1 mm at most and a voltage which can be applied is 5 kV at most, where the cross-sectional area is about 100 $\mu m\Phi$.

According to the method of forming a spacer with use of polyimide by a photolithography technique, disclosed in U.S. Pat. No. 5,063,327 described above, a number of spacers can be formed on a rear plate or a face plate, at once, so that the problem of complicated manufacturing steps can be reduced. However, the height of the spacers which can be formed is about several tens to one hundred microns at most, and the voltage which can be applied to the face plate is therefore restricted. In order to obtain a spacer as high as possible, processing may be repeated for a plurality of times. In this case, also, the manufacturing steps are complicated. Thus, it is difficult to apply an acceleration voltage of several kV to several tens kV, with use of a high acceleration fluorescent member used in a current CRT and having high performance, and therefore, it is unavoidable to use a low-acceleration fluorescent member which has only low performance including a luminance, a color purity and the like, so that an image-forming apparatus cannot achieve a high luminance or a high color purity.

Although U.S. Pat. No. 5,371,433 realizes a spacer height of about 1 mm by layering two layers of polyimide each having a height of 500 $\mu m$ and formed by a photolithography step (including mask exposure, development, and washing), it is not possible to avoid degradation of the bending strength caused by an increase in height of the spacer, in addition to difficulties in position alignment in layering. Therefore, a spacer must be provided for every one pixel.

(3) In an image-forming apparatus using a spacer made of organic resin, the manufacturing temperature for the image-forming apparatus is so high that a spacer requires an arrangement area.

The number of spacers required for supporting an air pressure is decided by the compression strength of the material used. Particularly, in an image-forming apparatus using an electron-emitting device, in order to reduce the pressure inside a vacuum envelope as much as possible, it is normally necessary to perform heating exhaustion for several hours or more at 200° C. to 300° C. Needless to say, a spacer is applied with an air pressure during heating exhaustion and therefore must have a sufficient air pressure strength, i.e., a sufficient compression strength.

Against an air pressure of 0.01 kgf/mm$^2$, glass material generally has a compression strength (or break-down limit) of about 10 kgf/mm$^2$ at 300° C., and the spacer area must be at least 0.1% of the area to be supported. Meanwhile, polyimide resin has a compression strength (or break-down limit) of about 2 to 5 kgf/mm$^2$ at 300° C., and the spacer area must be 2 to 5 times as large as that of a glass spacer. Further, in a display area of an image-forming apparatus, a spacer must be formed in a slight gap between pixels, so that the width of each spacer must be decreased. Therefore, the aspect ratio of the spacer, i.e., the ratio of spacer-height/spacer-width, is enlarged, so that bending tends to easily occur. Particularly, in some cases, resin having a low rigidity causes bending at a compression stress of a deformation limit or less. Therefore, it is necessary to provide many more spacers.

If the number of necessary spacers is thus increased, the manufacturing steps are complicated accordingly, resulting in a reduction in manufacturing yield.

Further, a step of forming a photolithography technique is carried out on a rear plate or a face plate, residues of polyimide may remain on the rear plate or face plate, or may damage the electron-emitting device during the step.

(4) A spacer using organic resin has a surface constituted by insulating material and has no function for preventing charging. Particularly, in an image-forming apparatus in which a high voltage is applied to a fluorescent member, the spacer surface may be charged and affect electron beams, possibly resulting in a problem that a discharge or the like occurs.

Figure 14:
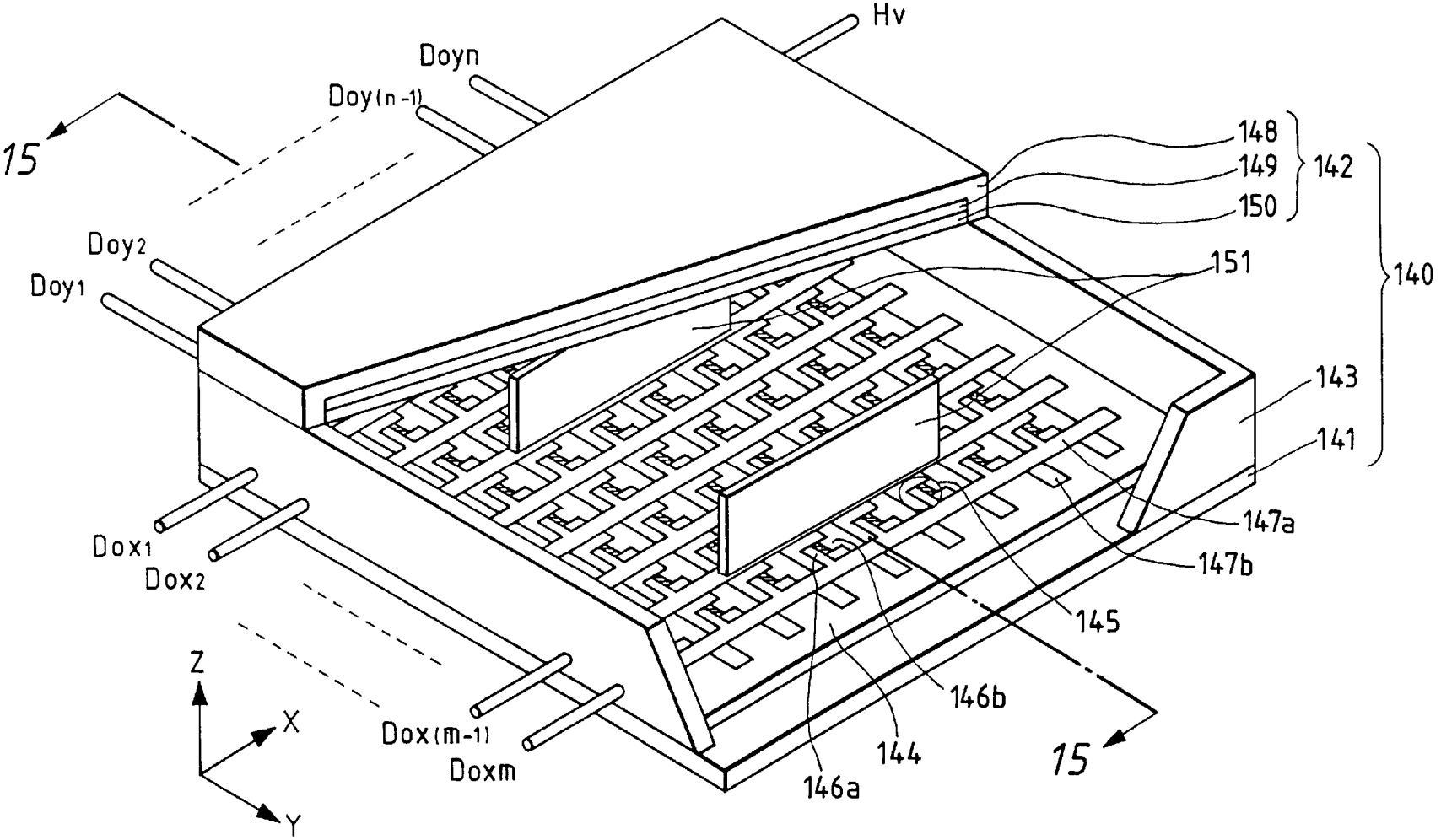
FIG. 14 PRIOR ART
FIG. 14 is a view explaining a conventional image-forming apparatus.

Resin or the like such as polyimide has an excellent dielectric breakdown voltage and has a high creeping discharge breakdown voltage, although the following problem occurs. Electrons emitted from a cold cathode electron-emitting device spread toward a face plate 142 shown in FIG. 14, so that there is a case that a part of the electrons is directly irradiated on the surface of spacers arranged to be adjacent to each other or a part of the irradiated electrons is reflected by a metal back 150 on the face plate 142 if the acceleration voltage is high. If a spacer made of organic resin is used, secondary electrons are then emitted from the spacer surface as a result and a corresponding part is charged. Charging of the spacer surface caused by collisions of electrons from outside reduces the creeping discharge withstand voltage or changes the surface potential, thereby distorting the electric field in the vicinity, so that the courses of electrons emitted from an electron source are affected.

If the courses of emitted electrons are thus deformed, a dislocation of the position on the face plate 142 to which an electron reaches increases as the flight distance of an electron increases, i.e., the distance d between the rear plate 141 and the face plate 142 increases. Therefore, if a spacer having a large height is used, electrons cannot reach desired positions on the face plate 142, resulting in a phenomenon such as a color dislocation in which the quality of an image is degraded.

(5) A spacer having a conductivity also has a problem that a charging phenomenon occurs. A vacuum film formation method is mainly used when providing a conductivity and cannot realize a low price. In particular, control of the conductivity causes difficulties when metal or metal oxide is used as conductive material.

When electrons enter into a spacer as described above, a charging phenomenon occurs. Although the secondary electron emitting coefficient of the conductive material is significant, metal oxide or metal has a secondary electron emitting coefficient greater than 1, in several cases, and therefore, material close to 1 is required. In addition, metal and metal oxide have a high conductivity rate so that it is difficult to control a high surface resistance.

The present invention has been made on the basis of the above knowledge. In the following, the present invention will be described in detail with reference to an example of a preferred embodiment.

An image-forming apparatus of the present invention comprises a rear plate on which an electron-emitting device is provided, a face plate having an image forming member and opposed to the rear plate, and a spacer provided between the face plate and the rear plate, characterized in that the spacer is formed by covering a spacer base material with organic resin and carbon and the carbon is included in a surface of the spacer.

In a first example of the structure of the image-forming apparatus according to the present invention, the image-forming apparatus has a spacer in which an organic resin layer in which the carbon is dispersed in the form of carbon powder covers the spacer base material.

It is preferred that the carbon powder is provided on the surface of the organic resin covering the spacer base material or a part of the carbon powder is exposed from the surface of the organic resin covering the spacer base material, and that the carbon powder made of carbon black, graphite, or a mixture thereof is contained in the organic resin at a rate of several wt % to several tens wt %. In addition, the spacer surface has a sheet resistance of $10^9\Omega/\square$ to $10^{12}\Omega/\square$.

In a second example of the structure of the image-forming apparatus of the present invention, the carbon in the form of a carbon layer covers the surface of the organic resin covering the spacer base material.

The carbon layer is a pyrolytic polymer layer or a layer including carbon particles made of graphite, amorphous carbon, or a mixture thereof and provided at a dot-like concave portion formed in the surface of the organic resin.

In another example of the structure, the carbon layer covers a part of the surface of the organic resin covering the spacer base material or each of the carbon and the organic resin in the form of a band cover the spacer base material. Preferably, a plurality of band-like carbon layers are formed. More preferably, the band-like carbon layer and the organic resin are arranged so as to form concave and convex portions. A relation of $1 \geqq P/2$ is satisfied where the pitch between convex portions of the organic resin is P and the width in the direction substantially vertical to the place plane of the band of the carbon layer is l. A thickness t of a concave portion of the organic resin covering the spacer base material satisfies a relation of $t \geqq 0.21$. The carbon layer formed in the concave portion has a thickness of 100 nm or more.

The carbon layer may contain catalytic metal of the iron family or the like such as Ni, Fe, Co, and the like. More preferably, carbon particles made of graphite, amorphous carbon, or a mixture thereof are provided on the surface of the convex portion of the organic resin covering the spacer base material. In addition, the sheet resistance of the spacer surface is $10^9\Omega/\square$ to $10^{12}\Omega/\square$.

In the first and second examples of the structure of the image-forming apparatus according to the present invention, the organic resin is preferably either polyimide resin or polybenzimidazole resin, and the polyimide resin is more preferably all aromatic polyimide.

The spacer base material is constituted by dispersing at least one fibrous filler of glass, alumina, boron, carbon, and a ceramic-based whisker, in a member made of glass, polyimide resin, or polybenzimidazole resin, and preferably contains the filler at a rate of 1 wt % to 50 wt % with respect to the organic resin.

In the image-forming apparatus of the present invention, it is more preferable that a contact layer is provided at a contact portion in the side of the face plate and/or the side of the rear plate of the spacer and that the contact layer is the carbon and is electrically connected with the carbon layer formed in the side surface of the spacer.

The spacer is preferably connected to an anode formed on the face plate and/or a drive wire formed on the rear plate, and the connection is preferably made by an adhesion member made of resin into which carbon powder is mixed.

In the image-forming apparatus of the present invention, the electron-emitting device is a cold cathode such as a field-emission electron-emitting device or a surface transfer type electron-emitting device.

In a third example of the structure of an image-forming apparatus according to the present invention, the image-forming apparatus comprises a rear plate provided with an electron-emitting device, a face plate having an image forming member and opposed to the rear plate, and a spacer provided between the face plate and the rear plate, and is characterized in that the spacer is formed by covering a spacer base material with organic resin and the spacer base material is constituted by dispersing at least one fibrous filler of glass, alumina, boron, carbon, and a ceramic-based whisker, in organic resin. The filler is contained at a rate of 1 wt % to 50 wt % with respect to the organic resin, the organic resin is preferably polyimide resin or polybenzimidazole resin, and further, the polyimide resin is preferably all aromatic polyimide.

In another example of the structure, the image-forming apparatus is characterized in that the spacer is formed by covering a spacer base material with organic resin, and the organic resin is polybenzimidazole resin.

A method of manufacturing a spacer for an image-forming apparatus according to the present invention is characterized by including a step of applying organic resin to the spacer base material.

The step of applying the organic resin is preferably a step in which the organic resin is applied by dipping the spacer base material in a solution containing the organic resin and by thereafter picking up the spacer base material.

The step of applying the-organic resin is a step of applying organic resin including carbon powder. In addition, the method of manufacturing a spacer for an image-forming apparatus is characterized by including a step of applying organic resin to the spacer base material and a step of carbonizing the organic resin.

The step of carbonizing the organic resin is a step of irradiating an electron beam to the organic resin, a step of heating organic resin applied to the spacer base material, or a step of heating by light irradiation, and particularly is a step of irradiating an electron beam or light in the form of a band to the organic resin such that the electron beam or light is substantially parallel to the plate.

Preferably, before the step of carbonizing the organic resin, there is provided a step of partially forming a catalytic metal layer on the spacer base material or organic resin applied to the spacer base material, and more preferably, in the step of forming a catalytic metal layer, the catalytic metal layer is formed in the form of a band such that the catalytic metal layer is substantially parallel to the plate.

In the step of forming the catalytic metal layer, an organic metal compound solution of the catalytic metal is added to the spacer material or organic resin applied to the spacer base material, by an ink-jet method.

The method of manufacturing a spacer for an image-forming apparatus is also a method including a step of irradiating an electron beam or light to the organic resin at a contact portion in the side of the face plate and/or the side of the rear plate of the spacer.

The method of manufacturing an image-forming apparatus is a method including a step in which a spacer formed by the above-described method of manufacturing a spacer for an image-forming apparatus according to the present invention is connected with an anode formed on the face plate and/or a drive wire formed on the rear plate.

According to the embodiments of the present invention described above, the following advantages are achieved.

According to the image-forming apparatus comprising a rear plate provided with an electron-emitting device, a face plate having an image forming member and opposed to the rear plate, and a spacer provided between the face plate and the rear plate, wherein the spacer has a spacer base material and is formed by covering the spacer base material with organic resin and the carbon is included in the surface of the spacer, the spacer has a high creeping discharge breakdown voltage, a characteristic of carbon having a secondary electron emitting coefficient close to 1, and a high mechanical strength of the spacer base material. As a result, the distance of 1 mm or more between the rear plate and the face plate can be realized without increasing the number of spacers, and therefore, a fluorescent member for a CRT, having a high performance at a low price, can be used with a high acceleration voltage. As a result, it is possible to provide an image-forming apparatus with a high luminance and a high color purity.

According to the first example of the structure of the image-forming apparatus according to the present invention, in which the image-forming apparatus has a spacer in which an organic resin layer in which the carbon is dispersed in the form of carbon powder covers the spacer base material, the spacer achieves an electric characteristic of a high resistance optimum for an image-forming apparatus in correspondence with a content of the carbon powder consisting of carbon black, graphite, or a mixture thereof with respect to the organic resin. Therefore, charging can be restricted even when an electron beam enters into a spacer, the power consumption is reduced, and a high acceleration voltage can be applied to a fluorescent member. As a result of this, it is possible to provide an image-forming apparatus having a high luminance and an excellent color purity.

According to the second example of the structure of the image-forming apparatus of the present invention, which has a spacer covering the surface of the organic resin covering the spacer base material, the following advantage is obtained.

The carbon layer is a pyrolytic polymer layer or a layer including carbon particles made of graphite, amorphous carbon, or a mixture thereof and provided at a dot-like concave portion formed in the surface of the organic resin. Therefore, the spacer achieves an electric characteristic of a high resistance optimal for an image-forming apparatus and charging can be restricted even when an electron beam enters into a spacer. The power consumption is reduced, and a high acceleration voltage can be applied to a fluorescent member. As a result of this, it is possible to provide an image-forming apparatus having a high luminance and an excellent color purity.

According to another example of the structure, the carbon layer covers a part of the surface of the organic resin covering the spacer base material, or each of the carbon and the organic resin in the form of a band cover the spacer base material and the band-like carbon layer and the band-like organic resin form concave and convex portions. Since the band-like carbon layer and the band-like organic resin form concave and convex portions, the creeping distance is increased and secondary electrons of electrons entering into the concave portion can be re-captured, depending on the shapes of the concave and convex portions. Therefore, charging can be restricted, and the creeping discharge breakdown voltage. Preferably, a concave shape or a high resistance layer of thermally decomposed polymer may be provided on the convex surface of the organic polymer. In addition, the carbon layer forming the concave portion has a high conductivity, and is therefore maintained at an equal potential, thereby restricting variations of the surface potential of the spacer. As a result of this, it is possible to provide an image-forming apparatus having a high luminance and an excellent color purity.

According to the first and second examples of the structure in which the organic resin is either polyimide resin or polybenzimidazole resin, it is possible to realize a high vacuum atmosphere in a container constituting an image-forming apparatus, and a high creeping resistance can be provided.

According to the first and second examples of the structure, in which the spacer base material is constituted by dispersing at least one fibrous filler of glass, alumina, boron, carbon, and a ceramic-based whisker or glass, it is possible to provide an image-forming apparatus using a spacer having a high aspect ratio and an excellent mechanical strength, in various embodiments. Therefore, it is possible to provide an image-forming apparatus at a low price, with a high luminance and an excellent color purity.

According to the image-forming apparatus of the present invention in which a contact layer is provided at a contact portion in the side of the face plate and/or the side of the rear plate of the spacer and the contact layer more preferably is the carbon and is electrically connected with the carbon layer formed in the side surface of the spacer, an ohmic contact of a low resistance is formed by a high-resistance film of the spacer and the electrodes or wires of the rear and face plates, so that a voltage drop is small at the contact layer. Therefore, electron beams emitted from the electron-emitting device are not affected, so that it is possible to provide an image of a high quality in which dislocations of positions are restricted. If the contact and connection between the spacer and the rear and face plates are constituted by an adhesion member made of resin into which carbon powder is mixed, carbon which is the same material as the contact layer of the spacer is used, so that an ohmic contact of a much lower resistance can be realized.

According to the image-forming apparatus of the present invention in which the electron-emitting device is a cold cathode such as a field-emission electron-emitting device or a surface transfer type electron-emitting device, it is possible to provide an image-forming apparatus with a high quality and a high reliability, due to a high speed response and a wise operation temperature range of the cold cathode electron-emitting device.

According to the third example of the structure of an image-forming apparatus according to the present invention, comprising a rear plate provided with an electron-emitting device, a face plate having an image forming member and opposed to the rear plate, and a spacer provided between the face plate and the rear plate, and characterized in that the spacer is formed by covering a spacer base material with organic resin and the spacer base material is constituted by dispersing at least one fibrous filler of glass, alumina, boron, carbon, and a ceramic-based whisker, in organic resin, it is possible to provide an image-forming apparatus which has a spacer with a high aspect ratio and an excellent mechanical strength, in various modifications. Therefore, it is possible to realize a high vacuum atmosphere in a container constituting an image-forming apparatus and to provide an image-forming apparatus capable of forming a high definition image at a low price due to the reduced number of spacers.

According to another example of the structure in which the spacer is formed by covering a spacer base material with organic resin, and the organic resin is polybenzimidazole resin, it is possible to realize a high vacuum atmosphere in a container constituting an image-forming apparatus.

According to the method of manufacturing a spacer for an image-forming apparatus according to the present invention, a step of applying organic resin to the spacer base material is included, and therefore, the film thickness of the organic resin layer can be adjusted. Further, the step of applying the organic resin is a step in which the organic resin is applied by dipping the spacer base material in a solution containing the organic resin and by thereafter picking up the spacer base material. Therefore, the film thickness can be adjusted. Further, by repetitions for several times, it is possible to obtain a large film thickness optimum for adjusting the creeping distance. In addition, since organic resin can be easily applied to the contact portion in the side of the face plate and/or the side of the rear plate of the spacer of the spacer base material, an advantage can be obtained for forming a contact layer described later.

The step of applying the organic resin is a step of applying organic resin including carbon powder. Therefore, it is possible to form a spacer having a high resistance, which is optimum for an image-forming apparatus, depending on the content of conductive carbon powder contained in the insulating organic resin.

The method of manufacturing a spacer for an image-forming apparatus is characterized by including a step of applying organic resin to the spacer base material and a step of carbonizing the organic resin. Therefore, it is needless to newly form a high resistance film by vacuum film formation or the like, so that a spacer having a high resistance, which is optimum for an image-forming apparatus, can be formed at a low price.

The step of carbonizing the organic resin is a step of irradiating an electron beam to the organic resin. Therefore, the resistance rate of the carbon layer can be freely controlled by the irradiation density and the irradiation time of an electron beam. The step of carbonizing the organic resin is a step of heating organic resin applied to the spacer base material or a step of heating by light irradiation. Therefore, the resistance rate of the carbon layer can be freely controlled by the heating time, the temperature, and the light amount. Particularly, the step of carbonizing the organic resin is a step of irradiating an electron beam or light like a band to the organic resin such that the electron beam or light is substantially parallel to the plate. Therefore, the conductivity of the organic layer can be selectively controlled.

Preferably, before the step of carbonizing the organic resin, there is provided a step of partially forming a catalytic metal layer on the spacer base material or organic resin applied to the spacer base material. Therefore, the temperature of the carbonizing step can be lowered and selective carbonizing can be performed in compliance with the shape into which catalytic metal is arranged. More preferably, in the step of forming a catalytic metal layer, the catalytic metal layer is formed in the form of a band such that the catalytic metal layer is substantially parallel to the plate.

In the step of forming the catalytic metal layer, the catalytic metal layer is formed in a manner in which an organic metal compound solution of the catalytic metal is added to the spacer material or organic resin is applied to the spacer base material. Thus, since the catalytic metal layer is not formed by a vacuum film formation method but is formed by an application method, the catalytic metal layer can be formed at a low cost. Particularly, in the case of applying the solution by an ink-jet method, the carbon layer can be formed in an arbitrary shape, with a high controllability.

The method of manufacturing a spacer for an image-forming apparatus is also a method including a step of irradiating an electron beam or light to the organic resin at a contact portion in the side of the face plate and/or the side of the rear plate of the spacer. Therefore, a contact layer of a low resistance can be formed at a low cost, without forming a contact layer such as a metal layer or the like.

The method of manufacturing an image-forming apparatus according to the present invention is a method including a step in which a spacer formed by the above-described method of manufacturing a spacer for an image-forming apparatus according to the present invention is connected with an anode formed on the face plate and/or a drive wire formed on the rear plate. Therefore, it is possible to provide an image-forming apparatus with a high luminance and a high quality at a low price.

Next, preferred embodiments of the present invention will be specifically explained with reference to the drawings.

Figure 2:
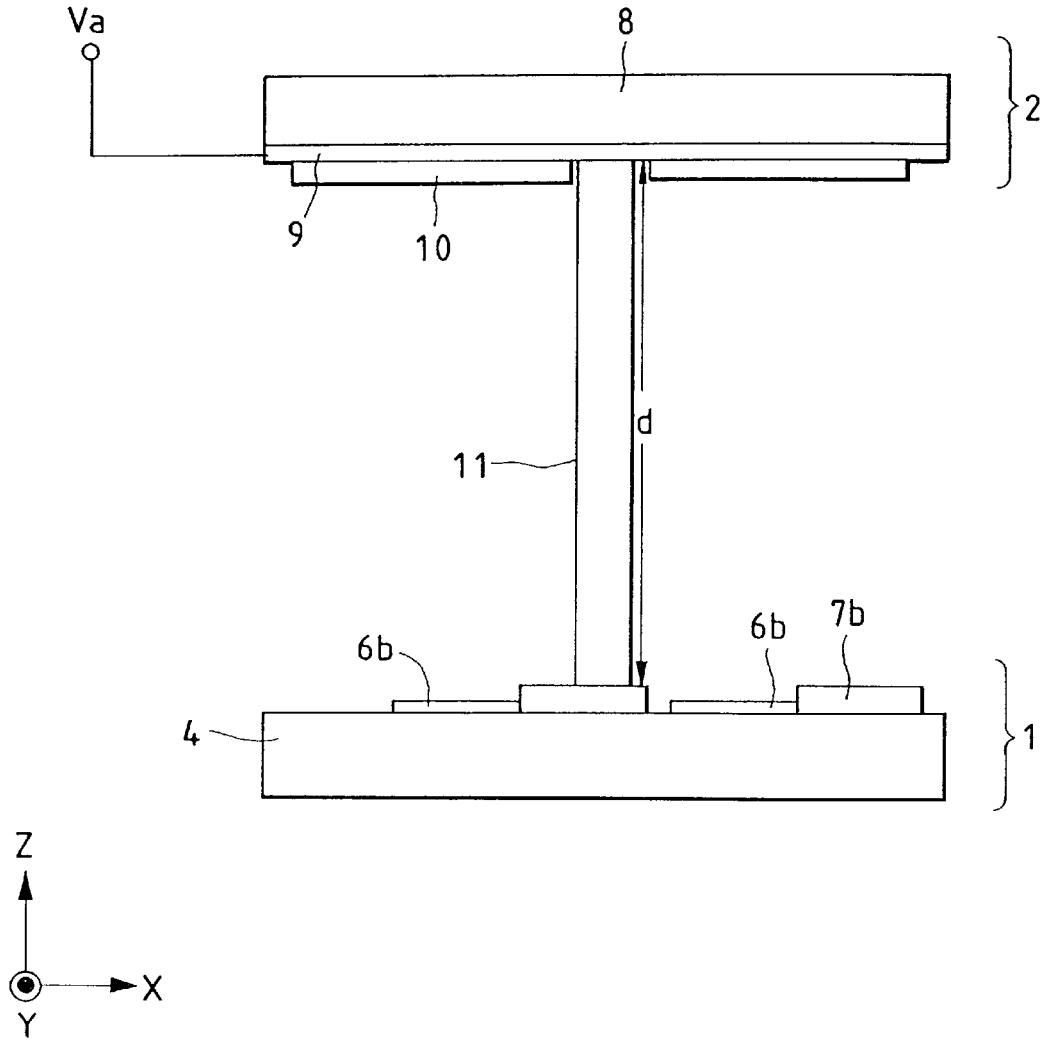
FIG. 2 is a cross-sectional view showing an example of an image-forming apparatus according to the present invention.

FIGS. 1 and 2 are schematic views showing a structure of an image-forming apparatus using a spacer according to the present invention. FIG. 2 is a 2—2 cross-section cut along a line 2—2 in FIG. 1. To simplify the explanation, devices are arranged in a matrix of 2 lines×2 rows.

In FIGS. 1 and 2, reference 1 denotes a rear plate as an electron source substrate, and reference 2 denotes a face plate as an anode substrate. Reference 3 denotes a support frame (combined with the face and rear plates to constitute an air-tight container), and reference 4 denotes a substrate as a base material of the rear plate 1. Reference 5 denotes an electron-emitting device, and references 6*a* and 6*b* denote electrodes for applying a voltage to the electron-emitting device 5. References 7*a* (signal electrode) and 7*b* (scanning electrode) denote electrode wires respectively connected to the electrodes 6*a* and 6*b*. Reference 8 denotes a substrate as a base material of the face plate 2. Reference 9 denotes a transparent electrode. Reference 10 denotes a fluorescent member. Reference 11 denotes a spacer.

The spacer 11 is made of a composite material consisting of organic resin and an inorganic material.

The structure of the spacer 11 will be explained with reference to FIGS. 3, 4, 5A, 5B, 6A and 6B.

Figure 3:
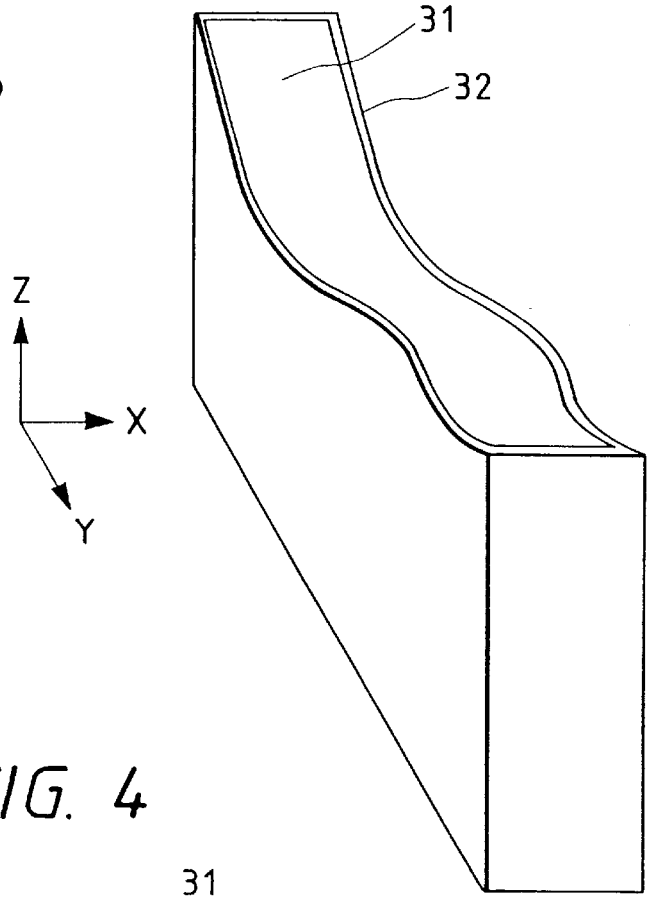
FIG. 3 is a schematic cross-sectional view showing a spacer used in an image-forming apparatus according to the present invention.

FIG. 3 is a horizontal cross-sectional view showing a spacer 11 according to a first structure preferable for the present invention. Reference 31 denotes a spacer base material and reference 32 denotes a surface coat layer. The spacer base material 31 is constructed mainly for the purpose of supporting an air pressure, and the surface coat layer 32 is constructed mainly for the purpose of improving the creeping discharge breakdown voltage of the spacer base material. The surface coat layer is a layer of an organic resin and carbon formed on the spacer base material. The carbon is provided at the surface of the surface coat layer. As will be described in detail later, the surface potential can be made more stable by using resin applied with a conductivity in the form of a surface coat layer 32.

A preferred example of material forming the spacer base material will be a glass material as described in relation to the prior art.

Needless to say, the size and shape of the spacer base material 31 is substantially equal to those of the spacer 11.

Where a high-acceleration fluorescent member for a CRT as described above is used, the height of the spacer base material 31 is preferably set to several hundreds $\mu$m to several mm, with respect to an applied voltage Va=several kV to several tens kV, and is more preferably set to about 1 mm to 4 mm.

Where a low-acceleration fluorescent member also described above is used, the height may be set to 100 $\mu$m with respect to Va=500 V.

The size and shape of the bottom surface of the spacer base material 31 are appropriately decided in compliance with a possible installation space particularly in a display section, i.e., the size and shape of an inter-pixel region decided by the pixel arrangement and the device pitch, and in compliance with design requisites such as a conductance during vacuum exhaustion in the panel.

Specifically, it is possible to adopt a structure in which a plurality of spacers each have a shape like a circular column, a square pole, layered columns, or parallel crosses, other than the spacer having a shape like a flat plate shown in FIGS. 1, 2, and 3.

As another preferred example of a material forming the spacer base material 31, it is possible to use a material in which an inorganic fibrous filler such as glass or the like is dispersed in resin. Resin as mother material preferably has an excellent heat resistance.

Resin materials generally have an excellent process ability and an excellent mass-productivity and are available at a low price. However, it is difficult to obtain a resin material having a high mechanical strength within a temperature range of room temperature to 300° C. or more.

Figure 13A:
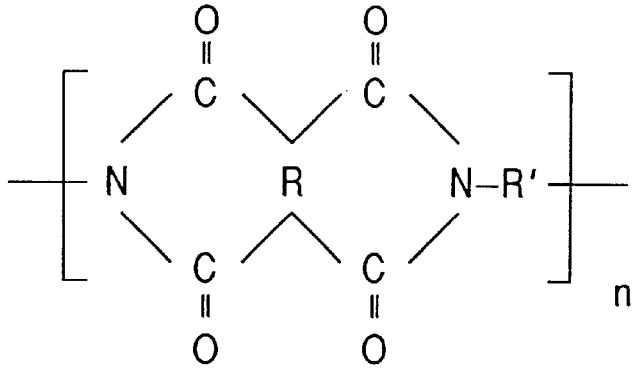
FIGS. 13A, 13B and 13C show typical chemical structures of the organic resin covering the spacer base material.
Figure 13B:
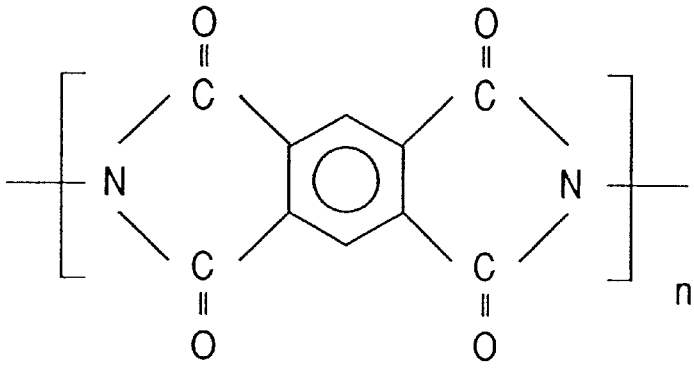
Figure 13C:
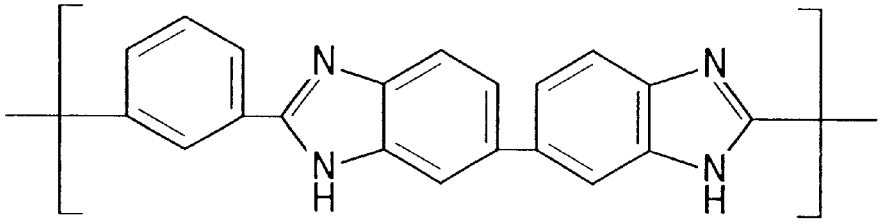

Therefore, the present invention uses a resin material obtained by dispersing an inorganic fibrous filler in polybenzimidazole resin or polyimide resin which has a high heat resistance and does not lower the operating atmosphere of a vacuum device, to greatly improve the mechanical characteristic of the composite material. The polyimide resin to be used for the purpose of the present invention is represented by the general formula shown in FIG. 13A. For example, the polyimide resin used in Example 2 is a completely aromatic polyimide resin as shown in FIG. 13B. The polybenzimidazole resin is typically represented by the formula shown in FIG. 13C which is referred to as poly-2, 2'-(m-phenylene)-5,5'-bibenzimidazole.

As general filler effects of a fibrous filler, the following are aimed: 1) an increase in tension strength; 2) an increase in elasticity rate; 3) an increase in bending strength; 4) an improvement in size stability; 5) an improvement in creep characteristic; 6) an improvement in camber; 7) an improvement in abrasion resistance; 8) an improvement in heat resistance (e.g., heat curing, heat deformation, linear expansion coefficients, and the like); and 9) an improvement in shock resistance. However, for use as a spacer material according to the present invention, 3) an increase in bending strength, 4) an improvement in size stability, and 8) an improvement in heat resistance (e.g., heat curing, heat deformation, linear expansion coefficients, and the like) are aimed.

Kinds of fillers are 1) general purpose: glass fibers, 2) ultra high strength: carbon fibers, alumina fibers, and boron fibers, 3) ceramics-based whiskers (mono-crystal needle-like chemical substances: silicon carbide, silicon nitride, and the like, and 4) others (mineral-based fibrous fillers): β-wollastonite (silica calcium), xonotlite. For use as a spacer material according to the present invention, particularly, it is preferable to combine the improvement in strength of the resin as a spacer base material and the heat expansion coefficient of glass material with the resin to form a face plate, a rear plate, and a support frame, and therefore, glass fibers, carbon fibers, and silicon carbide whiskers are particularly preferred.

The fiber length of a filler is preferably several μm to several tens μm. In addition, the filler content is 10 wt % to 50 wt % and is preferably 20 wt % to 40 wt %, depending of the strength and heat expansion coefficient, under an upper limit of 50 wt % at which the reinforcing effect is saturated.

A spacer prepared by dispersing those needle-like fillers in polyimide or polybenzimidazole resin has a high heat resistance and a high strength, and is capable of maintaining a sufficient strength enough to withstand vacuum baking at 300° C. for 10 hours, required for restricting gas discharging.

In addition, since the spacer base material of the present structure contains resin as a main component, the spacer can be molded by a mold method such as an injection mold method, a compression mold method, a pouring mold method, or the like. Thus, the spacer may be formed into a column, a prism, a column-stacked shape or a parallel-cross shape, in place of a plate such as is shown in FIGS. 1, 2 and 3, or a plurality of such spacers may be arranged in an envelope.

Table 1 shows a comparison example showing heat deformation temperatures and heat expansion rates in case of singly using polyimide resin and polybenzimidazole resin which can be prepared by an injection mold, and in case of using polyimide resin containing a filler and polybenzimidazole resin, preferable for the present invention, are used. In the table, the contents of the fibrous fillers are all 30 wt %.

TABLE 1

| | Heat deformation temperature | Heat expansion rate |
|---|---|---|
| Polyimide resin (Commercial name: AURUM 450 available from MITSUI TOATSU | 238° C. | $5.5 \times 10^{-5}$ cm/cm/° C. |

TABLE 1-continued

| | Heat deformation temperature | Heat expansion rate |
|---|---|---|
| KAGAKU KABUSHIKI KAISHA) | | |
| Glass-fiber-reinforced polyimide resin (Commercial name: AURUM JGN3030 available from MITSUI TOATSU KAGAKU KABUSHIKI KAISHA | 336° C. | $1.7 \times 10^{-5}$ cm/cm/° C. |
| Carbon-fiber-reinforced polyimide resin (Commercial name: AURUM JC N3030 available from MITSUI TOATSU KAGAKU KABUSHIKI KAISHA) | 342° C. | $0.6 \times 10^{-5}$ cm/cm/° C. |
| Polybenzimidazole resin (Commercial name: Celazole TU-60 available from Hoechst Industry Inc.) | 255° C. | $3.4 \times 10^{-5}$ cm/cm/° C. |
| Glass-fiber-reinforced polybenzimidazole resin (Commercial name: Celazole TU-60 available from Hoechst Industry Inc.) | 314° C. | $1.7 \times 10^{-5}$ cm/cm/° C. |

Organic resin is used as a material of the surface coat layer 32 for its manufacturing advantages of a high creeping resistance and easy coating. In particular, polybenzimidazole resin or polyimide resin is selected on the ground that these materials are capable of breakdown heat processing steps in air and vacuum and result in less gas discharging. As for polyimide resin, all aromatic polyimide has an excellent heat resistance and is therefore used preferably.

The surface coat layer itself does not require mechanical strength, so that the heat resistance is not defined by a heat deformation temperature or a glass transition point but is defined by a burning temperature in the air or a decomposition temperature. The above-described polybenzimidazole resin and all-aromatic polyimide resins have burning temperatures and decomposition temperatures exceeding 500° C. and can therefore be used preferably.

The above-described resin can be subjected to sufficient vacuum baking, e.g., baking at 300° C. for about 10 minutes. Therefore, gas discharging from the surface coat layer can be reduced as much as possible. As a result of this, the pressure in a vacuum container can be maintained at low and creeping discharging due to absorption of gas molecules to the surface can be avoided, so that the creeping resistance value can be substantially the same as a spark discharge voltage.

Table 2 shows examples of characteristics of the resin. If a material having a gas permeability is used as the material forming the surface coat layer, a material which results in relatively large gas discharging can be used as the spacer base material. However, since polybenzimidazole has an extremely small gas permeability, it is possible to use a spacer base material which has relatively large gas discharging, e.g., a ceramics-sintered body.

The polybenzimidazole coat layer can be easily coated with use of varnish. Varnish for forming a polyimide coat layer is available at a low price and ensures easy handling, so that varnish can be preferably used in the present invention.

In addition, the advantages of the present invention can be obtained if resin coated as a surface coat layer has a thickness of several nm or more. However, the film thickness is preferably 10 nm or more in consideration of uniformity of the film thickness, although the film thickness depends on coating methods. If the film thickness is 10 μm or more, cracking caused by a difference between heat expansion coefficients of a coated resin film and a base material or the surface coat layer may peel off due to film stress. Therefore, the film thickness of the resin is preferably 10 nm to 10 μm, and more preferably, 0.1 μm to 10 μm in consideration of control of a film thickness.

TABLE 2

| | Decomposition temperature | Heat expansion rate | Creeping resistance | Gas discharge rate |
|---|---|---|---|---|
| Polybenzimidazole | 580° C. (in the air) | $3.3 \times 10^{-5}$ cm/cm/° C. | 10 kV/mm or more | cannot be measured |
| All aromatic polyimide | 550° C. (in the air) | $5.4 \times 10^{-5}$ cm/cm/° C. | 10 kV/mm or more | $10^{-8}$ torr · 1/cm$^2$ · sec |

Next, a spacer of a second structure preferable for the present invention will be explained. The spacer has a structure basically equal to that shown in FIG. 3.

Resin containing a carbon filler is coated as the surface coat layer 32 used in the second structure, so that the secondary electron emission coefficient of the spacer surface is close to 1 and an appropriate conductivity is obtained to prevent charging from occurring on the spacer surface.

A carbon material is a conductive material having a secondary electron emission efficiency close to 1, as described above, and therefore can be preferably used in the present invention.

The above-described polybenzimidazole resin or polyimide resin is preferably used as a mother material of the surface coat layer 32. A carbon filler to be contained may be furnace black, channel black, acetylene black, thermal black, lamp black, natural graphite powder (crushed and classified to grain diameter of about 100 nm).

As has been described above, if the potential of the spacer surface is not uniform or stable due to a factor that electrons enter into the spacer surface, courses of electrons emitted from an electron-emitting device 5 in the vicinity of a spacer 11 are curved or swing in some cases. Non-uniformity and non-stability of the potential of the spacer surface are caused by emission of secondary electrons due to collisions of electrons and charging caused therefrom, and therefore, can be avoided by making the secondary electron emission coefficient of the spacer surface close to 1, and by applying an appropriate conductivity to the spacer surface. In order to obtain this advantage, the surface resistance (i.e., the sheet resistance $Rs=\rho/w$: the resistivity of the surface coat layer applied with a conductivity and w denotes a film thickness) should preferably be about $10^{12}\Omega/\square$ or less. However, if the resistance of the surface coat layer is too low, heat is generated and causes a break-down of the surface coat layer and an increase in power consumption due to a heat running-out current.

The lower limit of the resistance differs, depending on a voltage applied to the face plate or the like. However, when applying a voltage of 10 kV, a resistance of $Rs=10^{9}\Omega/\square$ or more is required. Therefore, in order to obtain the advantage of the present invention, the film thickness of the surface coat layer and the resistivity thereof are adjusted by setting the resistance Rs of the resin coat layer applied with a conductivity to $10^{9}\Omega/\square$ to $10^{12}\Omega/\square$.

The resistivity adjustment of the surface coat layer in case of containing a carbon filler in resin can be realized by changing the density of the carbon filler in the resin. The resistivity can be adjusted within a range of about 1 to $10^{8}$ Ω cm by changing the carbon content ratio in the resin from several weight % to several tens weight %, although the resistivity differs depending on the kind and the grain diameter of the resin and carbon powder to be used. For example, by mixing furnace black having an average grain diameter of 29 nm into all-aromatic polyimide resin at 18 wt %, a resistivity of about $3\times10^{4}\Omega/\square$ is obtained. If this material is formed with a thickness of 0.1 μm, a surface coat layer having a sheet resistance of about $3\times10^{9}\Omega/\square$ is obtained.

Figure 4:
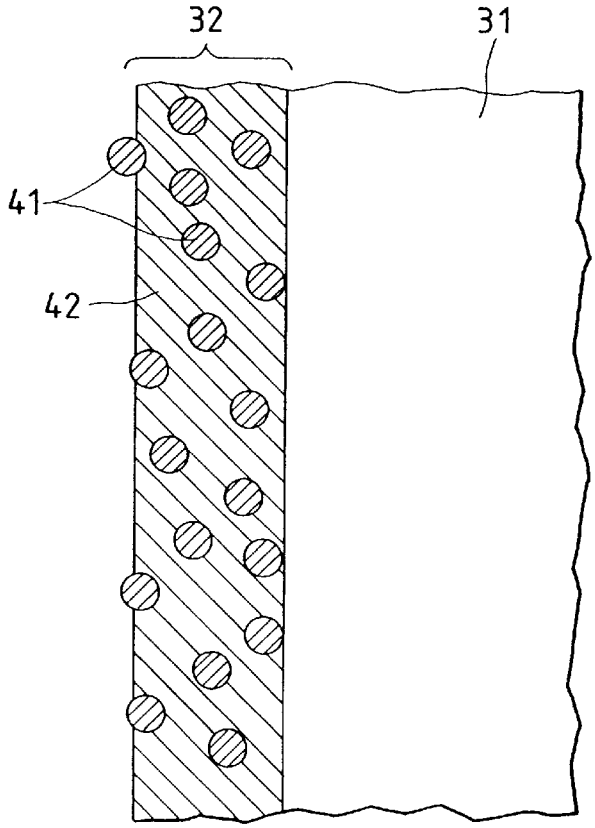
FIG. 4 is a cross-sectional view showing a spacer which can be used in an image-forming apparatus according to the present invention.

The shape of the surface of the surface coat layer is schematically shown in FIG. 4 where a carbon filler is contained in the resin. In this figure, reference 41 denotes a carbon filler, and reference 42 denotes resin. As shown in FIG. 4, a part of the carbon filler 41 is exposed from the surface of the surface coat layer 32, and serves to make the secondary electron emission efficiency to 1 on the surface and to prevent charging on the surface.

Otherwise, the carbon layer may be formed by carbonizing at least a part of the surface coat layer made of organic resin or particularly made of polybenzimidazole resin or polyimide resin.

A third structure of the present invention is constructed in the following where at least a part of the surface coat layer is carbonized to form a carbon layer.

Figure 5A:
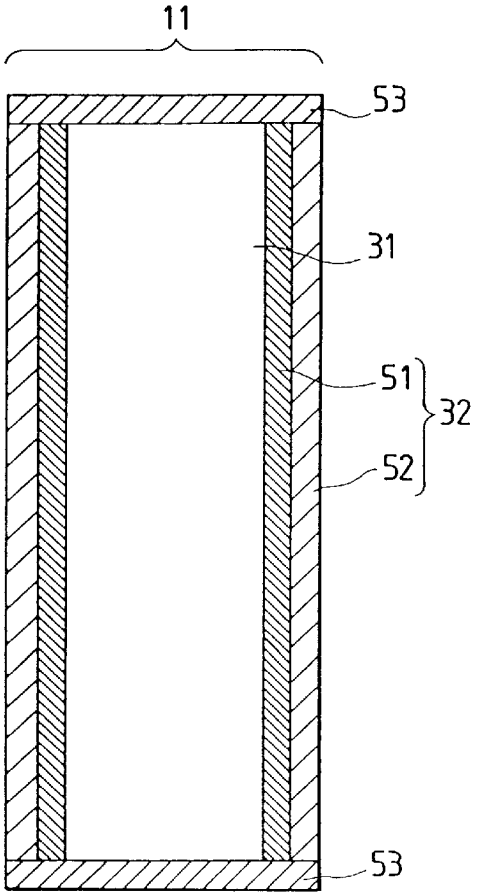
FIGS. 5A and 5B are views showing spacers for use in an image-forming apparatus according to the present invention.
Figure 5B:
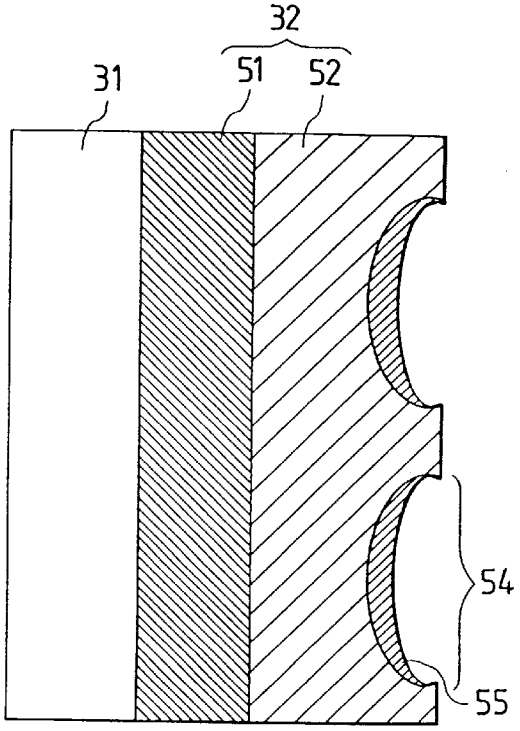

FIGS. 5A and 5B show an example of a partial cross-section of a preferred spacer structure of the present invention, the surface layer of which is made of a resin layer and a carbon layer. FIG. 5B is an enlarged view of the structure having dot-like concave portions (described below) on the surface. Reference 51 denotes a resin layer and reference 52 denotes a carbon layer. Reference 53 denotes a contact layer for electrically connecting wires of a rear plate and a face plate, not shown in the figure. Reference 54 denotes a concave portion in which a graphite layer 55 is formed.

The resin layer 51 is preferably made of polybenzimidazole or polyimide resin as described above, but is not limited thereto.

In the structure shown in FIGS. 5A and 5B, the resistance adjustment of the surface coat layer described above is carried out by adjusting the material and form of the carbon layer 52. The crystal characteristic and form of carbon forming the carbon layer 52 will be explained below. Carbon includes graphite (including so called HOPG, PG, and GC: HOPG is a substantially perfect crystal structure, PG consists of crystal grains of about 20 nm and has a slightly disarranged crystal structure, and GC consists of crystal grains of about 2 nm and has a more disarranged crystal structure), non-crystal carbon (including amorphous carbon and a mixture of amorphous carbon and crystallite of the graphite described above), and conducive pyrolytic polymer formed by heat decomposition of resin. As for the form, the resin described above, the resin described above on the main surface of the pyrolytic polymer, or the pyrolytic polymer described above is carbonized to form the carbon layer, particularly when the layer is made of graphite having a high conductivity of a conductivity rate of 10 S/cm to $10^{-4}$ S/cm. Therefore, the portion thus carbonized is a concave portion in accordance with a reduction in volume and has a form of dispersed dots (FIG. 5B). On the other hand, pyrolytic polymer having a low conductivity rate and a high resistance has a film-like structure (FIG. 5A). Here, the sheet resistance is preferably within the same range as the second structure, e.g., $10^9\Omega/\square$ to $10^{12}\Omega/\square$. Such a layer having these configurations is referred to here as a high resistance layer.

The contact layer 53 is a layer for making an ohmic contact with wires and electrodes of the face and rear plates, and is required since a potential drop will occur in the contact to greatly affect electron beams emitted from an electron-emitting device layer if an ohmic contact cannot be obtained or the contact resistance is high. The contact layer is made of a carbon layer, so that it is unnecessary to newly form a contact layer made of metal or the like. In addition, since the contact layer is made of the same material as the surface coat layer, an ohmic contact is preferably obtained. However, it is possible to newly form a contact layer made of metal or the like.

Figure 6A:
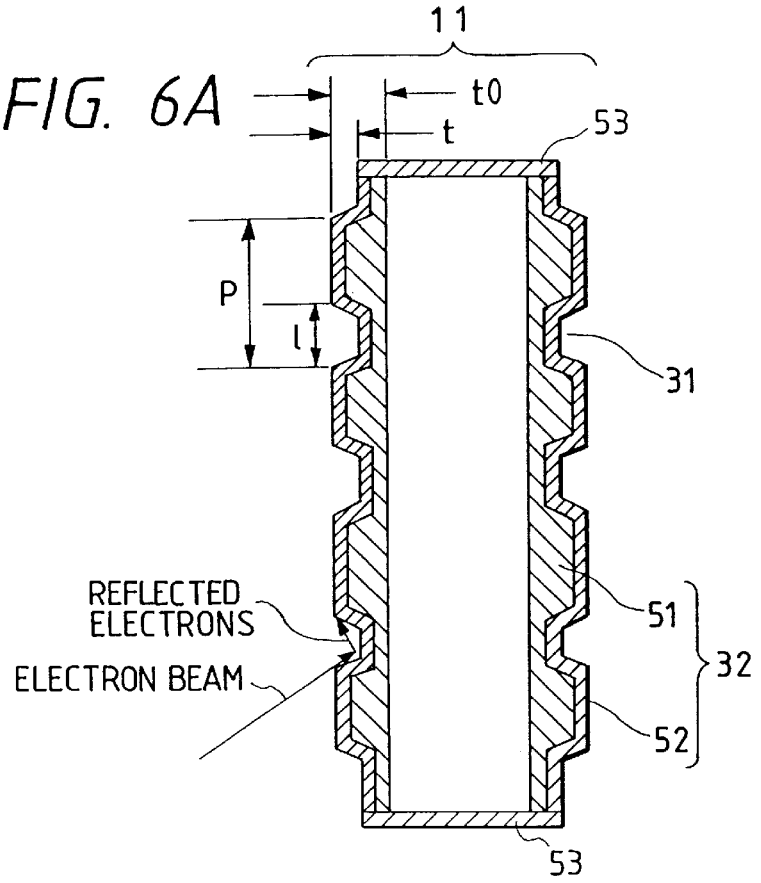
FIGS. 6A and 6B are views showing a spacer for use in an image-forming apparatus according to the present invention.
Figure 6B:
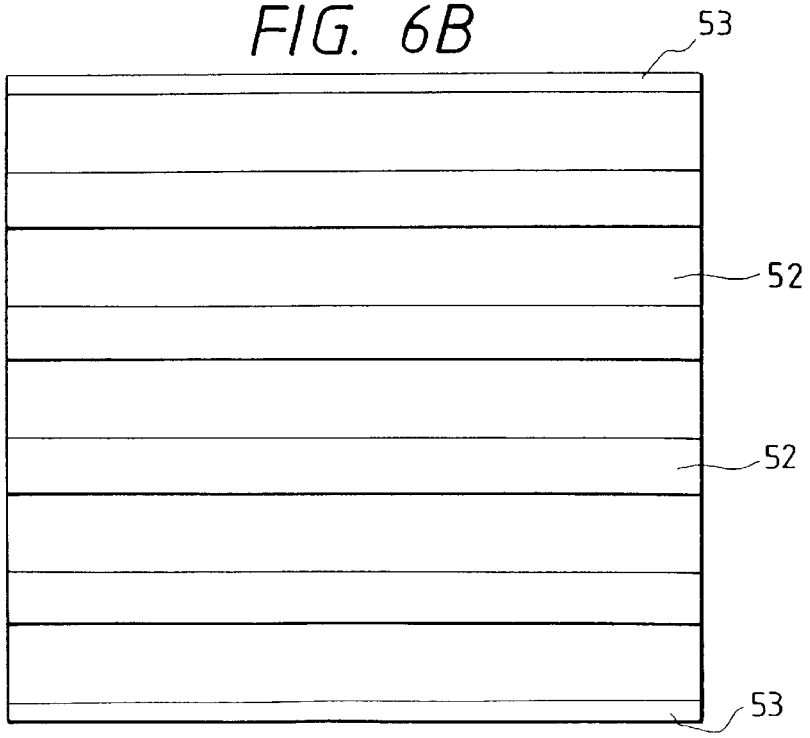

FIGS. 6A and 6B are partial enlarged views showing a fourth structure of the spacer 11 according to the present invention, which has a surface coat layer consisting of a resin layer and a carbon layer. FIG. 6A is a cross-sectional view and FIG. 6B is a side view. FIGS. 6A and 6B show a case where concave and convex portions are formed like bands to increase the creeping distance and a high resistance layer is formed on the convex surface. In FIG. 6A, reference P denotes a repetition pitch of the band-like concave and convex surfaces and reference 1 denotes the length of the band-like concave surfaces. Reference t denotes a difference between the thickness at the concave surfaces and the thickness at the convex surfaces. Reference denotes the thickness at the convex surface. Note that the length l of the band-like concave surfaces is defined as the length between center points of slanting portions of each concave surface.

In FIGS. 6A and 6B, a spacer 11 has a carbon layer 52 on the concave and convex surfaces of the resin layer 51 and the creeping distance is increased by the concave and convex surfaces. As is shown in FIG. 6A, the shape of the concave surface is arranged in a shape in which generated secondary electrons enter again into the carbon layer of the concave surface where an electron beam from an electron-emitting device enters, and carbon which has a secondary electron emission coefficient close to 1 is used. Therefore, the secondary electron emission coefficient substantially approximates to 1. As for the pitch P of the band-like concave and convex surfaces and the length l thereof is not limited to $P \cong 1$ which is shown in this figure, but $1>P/2$ is preferably used in consideration of re-capture of generated secondary electrons.

The depth t and the shape of the concave surface are designed in consideration of the creeping distance and influences on capture of secondary electrons. Although it is preferable that $t \geqq 0.21$ is satisfied, the depth t is decided by a weight loss and a reduction in volume caused by carbonizing resin and is dependent on the material. Further, since the thickness of the resin layer is reduced to 30% at most, the thickness satisfies $t \geqq 0.7t\mathbf{0}$ where the thickness from the position of the carbon layer in the side of the base material to the surface side of the resin layer is a resin layer thickness t0. As will be described later, if carbon is partially removed by irradiating electron beams, light, or the like is irradiated on the concave surface, the difference t between the thickness at the concave surface and the thickness at the convex surface can vary not only within a range of $t \leqq 0.7t\mathbf{0}$ but also within a range of $t<t\mathbf{0}$. The shape of the concave and convex surfaces described above should preferably be a curved shape without sharp angles, so that the electric field is not concentrated to emit electrons. As described above, as for the concave and convex surfaces, the creeping distance is designed in compliance with an anode voltage Va to be applied and the intensity of the electric field, and the shape parameters P; l, and t of the concave and convex surfaces are appropriately set. In addition, the shape parameters P, l, and t may be different from each other or may be formed partially, within one same spacer.

Further, in this structure, a high resistance layer may be formed by forming a carbon layer 52 also on the surface of the concave surface resin layer. The high resistance layer has a structure such as shown in FIGS. 5A and 5B. In addition, since the carbon layer of the concave surface is highly conductive, it is possible to restrict variations of the potential of the spacer surface generated by partial variations of the resistance value of the surface of the carbon layer 52 of the convex surface resin layer, to provide a stable uniform potential to the entire spacer. In this case, if the carbon layer is graphite or non-crystal carbon having a high conductivity among the materials described above and has a film thickness of 100 nm or more, the voltage drop at the carbon layer is restricted to be 10 V or less. In the case of a spacer described in this embodiment, the voltage drop is restricted to 10V or less, so that an effect of uniform potential can be achieved by a carbon layer. Therefore, the lower limit of the film thickness of the carbon layer is 100 nm. In addition, the ohmic contact layer 53 is preferably connected to the band-like carbon layer provided on the spacer base material, in consideration of the contact resistance.

Figure 7A:
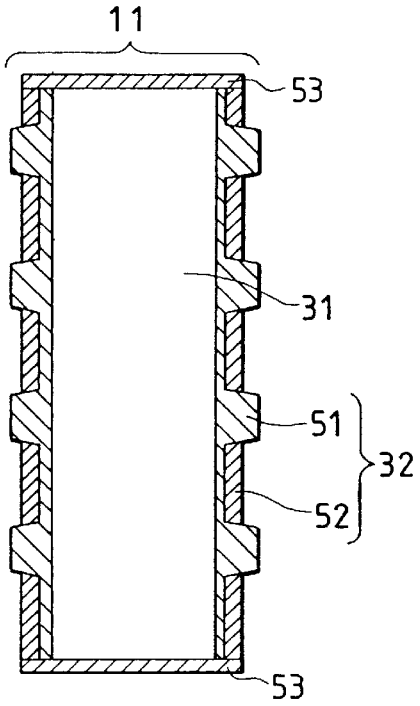
FIGS. 7A, 7B, and 7C are views showing a spacer for use in an image-forming apparatus according to the present invention.
Figure 7B:
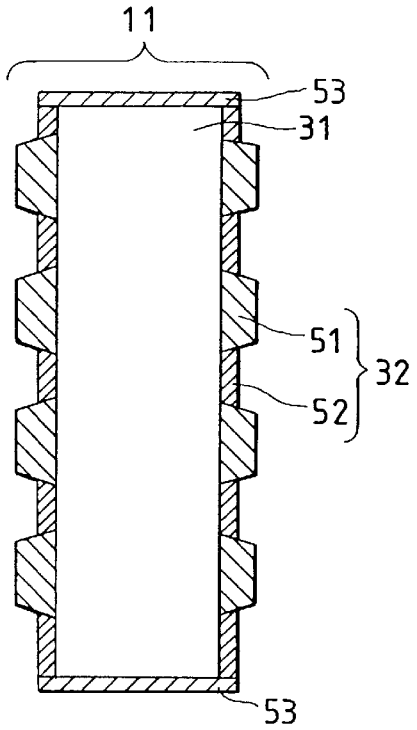
Figure 7C:
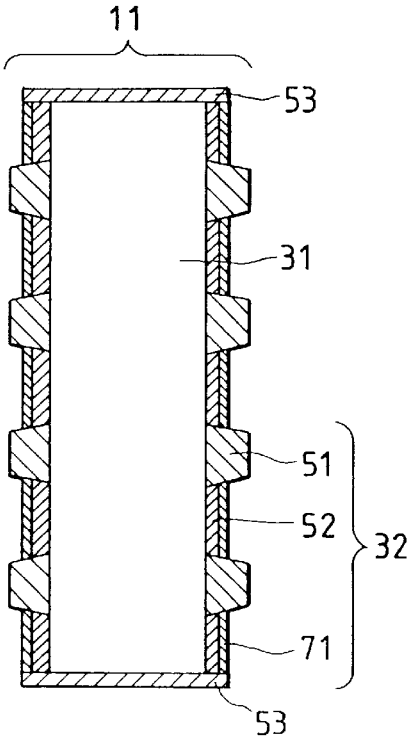

FIGS. 7A to 7C show another example of a fourth structure of the present invention.

FIG. 7A shows a case where a carbon layer 52 is not formed on the convex surface of the spacer 11 shown in FIGS. 6A and 6B. The high resistance carbon layer 52 need not always be formed on the convex surface where the anode voltage is not extremely high and the creeping resistance can be sufficiently maintained by an increase of the creeping distance due to the concave and convex surfaces and by re-capture of secondary electrons or where $l>>\frac{1}{2}P$, that is the case that the organic resin area, i.e., the area to be charged, is reduced, particularly where P is less than 200 $\mu$m.

FIG. 7B shows a case where a resin layer 51 is not provided between the concave surfaces of the spacer 11 and the spacer base material 31. Where there is a risk that a movement of impurities from the spacer base material 31 to the surface may occur, e.g., that a movement of sodium ions may occur when using soda lime glass for the spacer base material, it is not preferable that the carbon layer 52 has a direct contact with the surface of the spacer base material 31. In this case, by providing a resin layer 51 between the carbon layer 52 of the concave surface of the spacer 11 and the spacer base material 31, it is possible to avoid a problem that the resistance of the carbon layer 52 greatly changes from the design value, for example. However, where there is not a risk as described above with respect to the spacer base material, e.g., where non-alkali glass, potassium-substituent glass, or the like is used, the resin layer 51 is not particularly required between the concave surfaces and the spacer base material 31.

FIG. 7C shows a case in which a carbon layer 52 containing catalytic metal is formed on the concave surfaces of the carbon layer shown in FIG. 7B. The catalytic metal layer 71 uses-metal material of the iron family such as Ni, Co, Fe, or the like and metal material of the platinum group such as Pd, Pt, or the like. In addition, metal of the iron family is particularly preferable for temperature reduction.

The catalytic metal carbonizes the resin layer 51 at a lower temperature, and therefore, serves to simplify the carbonizing step and to selectively and partially form the carbon layer 52. Note that the catalytic metal can be not only previously formed on an organic resin layer which forms a concave surface to perform carbonization, but also can be provided between the convex surface and the spacer base material 31 or mixed into the organic resin layer.

Next, the method of manufacturing a spacer of the present invention having the third or fourth structure will be explained with reference to a spacer shown in FIGS. 5A, 5B, 6A, 6B, 7A, 7B and 7C. The method of manufacturing a spacer of the present invention does not adopt a vacuum film formation method, unlike the prior art, but can adopt a simple process, so that a spacer which has a high discharge-withstand voltage and is difficult to be charged can be provided at a low cost.

The method of manufacturing a spacer according to the present invention is characterized by comprising the following steps.

Step a: a step of applying an organic resin solution to a spacer base material cut into a plate-like shape.

Step b: a step of hardening organic resin applied by the step a.

Step c: a step of carbonizing the organic resin hardened by the step b.

In the step a of applying a resin solution or a solution of a precursor of resin to a spacer base material cut into plate-like shape, the solution can be applied to the spacer base material by a spinner. However, this step is preferably arranged to be a step in which the spacer base material is dipped in a solution containing resin or a precursor of resin and is thereafter picked up, thereby applying the solution, the solution is applied to the entire spacer base material including end surfaces thereof. An organic resin layer can have a desired thickness by repeating the step a or by repeating the steps a and b after the step b is once completed.

The step b of hardening resin applied by the step a is a step in which an organic solvent in the organic resin solution is removed by evaporation to harden the resin on the spacer base material, or a step in which an organic solvent in the solution containing a precursor of resin is removed by evaporation and the resin is hardened on the spacer base material by a chemical reaction bridging, condensation, or the like.

A part of the spacer structure applicable to the present invention can be formed in the process of step b. The following is, a method of manufacturing a spacer structure in which the surface coat layer consists of a carbon layer and a resin layer.

The step c of carbonizing the resin hardened by the step b adopts irradiation of an electron beam or light, or heating in a vacuum or an inactive gas.

If resin is heated in a vacuum or an inactive gas, resin is thermally decomposed by heat and carbonized. In accordance with the carbonization, the volume decreases by several tens % or more. In this stage, if catalytic metal having an effect of lowering the carbonization temperature is previously formed on the spacer base material or is mixed in a resin solvent, selective carbonization occurs in the periphery of metal by the effect of catalytic metal by formation thereof on resin.

In addition, if resin is heated by light irradiation in an inactive gas, resin is thermally decomposed and carbonized. Infrared light or visible light is irradiated from a lamp as a light source, or a laser beam is irradiated.

Resin can be carbonized by irradiating an electron beam to a resin layer in a vacuum. Irradiation conditions of an electron beam are mainly decided by thermal conditions, i.e., by the electron beam density of an electron beam. If the electron beam density of an electron beam is low, resin is decomposed, forming pyrolytic polymer or amorphous carbon. If the electron beam density is more increased, graphite is formed.

If carbonization of the resin layer is partially and selectively performed like spacers shown in FIGS. 6A and 6B and FIGS. 7A to 7C, carbonization selectively occurs at a portion where a catalytic metal layer is provided, by previously forming catalytic metal on the spacer base material or the organic resin in a shape into which the metal is to be carbonized. If catalytic metal is previously mixed in organic resin, carbonization is carried out at a low temperature.

The method of applying catalytic metal preferably adopts an ink-jet method used for a printer. Specifically, after a solution containing organic metal is blown out through an ink-jet nozzle to apply an organic metal solution in a desired pattern onto a spacer base material, catalytic metal of a desired pattern can be obtained by heat decomposition. Here, the organic metal solution is preferably a solution in which an organic metal complex is solved in a solvent. In addition, the ink-jet method used is preferably a piezo-jet method using a piezoelectric element or a bubble-jet method using thermal energy.

In addition, in case of irradiating an electron beam or light, irradiation of-an electron beam or light may be performed in accordance with a pattern in which carbonization is to be performed. Further, if an electron beam or light is irradiated on a concave surface, carbon in the concave surface decreases, the difference t between the thickness at the concave surface and the thickness at the convex surface increases, and further, the creeping distance can be increased. In addition, carbonization can be performed not only on the concave surfaces but also on the organic resin of the surface layer on the convex surfaces, by setting the amount of electrons to be irradiated on the concave and convex surfaces and the irradiation time.

The carbonizing step described above can be used for forming an ohmic contact layer by carbonizing organic resin formed on end surfaces of the spacer base material.

The above-described manufacturing methods of the present invention may be used singly or in combination.

A rear plate 1 is an electron source substrate constructed by arranging a number of electron-emitting devices on a substrate 4. As the substrate 4, it is possible to use quartz glass, soda lime glass, glass having a reduced content of impurities such as Na or the like, a glass substrate in which $SiO_2$ is layered on blue plate glass, ceramics such as alumina or the like, an Si substrate, or the like. Particularly, in case of forming a large screen display panel, blue plate glass, sodium glass, and a glass substrate obtained by layering $SiO_2$ on blue plate glass by a liquid-phase growth method, a sol-gel method, or a sputter method are of low costs and can preferably be used.

As an electron-emitting device, a surface-transfer type electron-emitting device is used.

The present invention is preferably applicable not only to a surface conduction electron-emitting device but also to a field-emission electron-emitting device, metal-insulating-material/metal type electron-emitting device, a diamond-type electron-emitting device, and the like.

Figure 8:
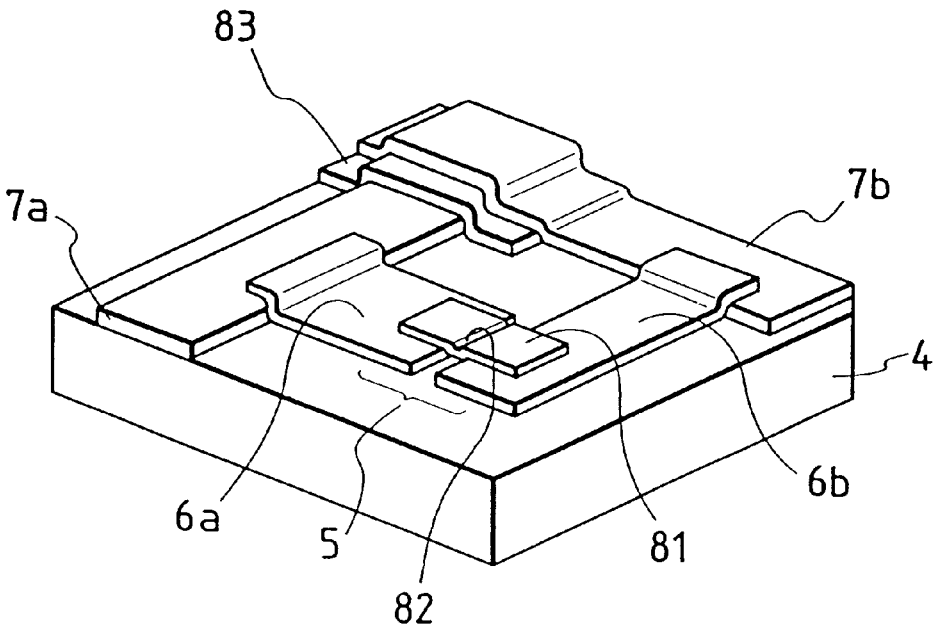
FIG. 8 is a schematic view showing a surface conduction electron-emitting device which can be used in an image-forming apparatus according to the present invention.

FIG. 8 is a schematic enlarged view showing a surface-transfer type electron-emitting device used in an image-forming apparatus shown in FIGS. 1 and 2. In FIG. 8, the same portions as those in FIGS. 1 and 2 are denoted by the same references as those in FIGS. 1 and 2. In FIG. 8, reference 81 denotes a conductive thin film, and reference 82 denotes an electron-emitting portion. Reference 83 denotes an inter-layer insulating layer for electrically separating wire electrodes 7*a* and 7*b* from each other. The conductive thin film 81 is preferably a particle film made of conductive particles and having a thickness within a range of 1 nm to 50 nm, for example.

As a material for forming the conductive thin film 81, it is possible to use various conductive materials or a semiconductor. Particularly, Pd, Pt, Ag, Au, PdO, or the like is preferably used which is obtained by heating and sintering an organic compound containing a noble metal element such as Pd, Pt, Ag, Au, or the like.

The electron-emitting portion 82 is constituted by a fissure of a high resistance formed at a part of the conductive thin film 81 and has carbon at the ends of the fissure. In several cases, conductive particles having a grain diameter which is greater by several to several hundred times than 0.1 nm and contains an element of material forming the conductive thin film 81, carbon, and a carbon compound may exist inside the electron-emitting portion.

As the electrodes 6*a* and 6*b*, a general conductive material may be used. For example, the material can be appropriately selected from a printed conductive material consisting of metal, such as Cr, Au, Mo, W, Pt, Ti, Al, Cu, Pd or the like or metal alloy thereof, metal or metal oxide such as Pd, Ag, Au, RuO2, Pd—Ag or the like, glass and the like, a transparent conductive material such as $In_2O_3$—$SnO_2$ or the like, and a semiconductor conductive material such as polysilicon or the like.

As for an arrangement of electron-emitting devices 5, various arrangements may be adopted. Explained herein is an arrangement called a simple matrix layout. A plurality of electron-emitting devices 5 are disposed in lines and rows respectively extending in the X- and Y-directions. Electrodes 6*a* of a plurality of electron-emitting devices 5 disposed in one same line are commonly connected to a wire 7*a* extending in the X-direction, and the other electrodes 6*b* of a plurality of electron-emitting devices 5 disposed in one same row are commonly connected to the wire 7*b* extending in the Y-direction. Both the X-direction wire electrode 7*a* and the Y-direction wire electrode 7*b* can be made of conductive metal or the like formed by a vacuum deposition method, a printing method, a sputter method, or the like. The material, thickness, and width of wires may be appropriately designed. In addition, the inter-layer insulating layer 83 is an insulating layer formed by subjecting glass, ceramics, or the like to a vacuum deposition method, a printing method, a sputter method, or the like.

For example, the film thickness, material, and manufacturing method are appropriately set so that formation of a desired shape is obtained on the entire surface or a part of the surface of the substrate 4 on which an X-direction wire 7*a* is formed. The X-direction wire 7*a* is connected with a scanning signal apply means not shown, for applying a scanning signal for selecting a line of electron-emitting devices 5 disposed in the X-direction.

Meanwhile, the Y-direction wire 7*b* is connected with a modulation signal generation means not shown, for modulating respective rows of electron-emitting devices 5 disposed in the Y-direction, in correspondence with an input signal. The drive voltage applied to each electron-emitting device is supplied as a differential voltage between a scanning signal and a modulation signal applied to a corresponding device.

In the structure described above, it is possible to separately select and independently drive a device with use of a simple matrix wire.

In addition to the structure described above, there is another structure adopting a ladder-like layout. in the ladder-like layout, a number of electron-emitting devices disposed in parallel with each other are connected with each other at both ends, and a number of lines (called line directions) of electron-emitting devices are provided. Electrons from the electron-emitting devices are controlled and driven by control electrodes (called grids) provided above the electron-emitting devices in a direction (called a row direction) perpendicular to the wire. However, the present invention is not limited by the layouts described above.

A face plate 2 is an anode substrate in which a transparent electrode 9, a fluorescent film 10, and the like are formed on the surface of a substrate 8. it is needless to say that the substrate 8 is transparent. Preferably, the substrate 8 has a mechanical strength and heat characteristics similar to a substrate 4 for a rear plate 4. In case of constructing a large screen display panel, it is preferable to use blue plate glass, potassium glass, or a glass substrate in which $SiO_2$ is layered on blue plate glass by a liquid-phase growth method, a sol-gel method, a sputter method, or the like.

A transparent electrode 9 is applied with a positive high voltage Va from an external power source not shown. As a result, electrons emitted from an electron-emitting device 5 are attracted to the face plate 2, and are accelerated and irradiated onto a fluorescent film 10. In this stage, if electrons thus entering have energy sufficient for making the fluorescent film 10 radiate, a luminance point can be thereby obtained.

In general, a fluorescent member used in a CRT for a color TV set obtains an excellent luminance and excellent coloring by accelerating and irradiating electrons with an acceleration voltage of several kV to several tens kV. A fluorescent member for a CRT is available at a relatively low price and has very high performance, so that this fluorescent member can be preferably used in the present invention.

In a general technique, a thin aluminum film called a metal back not shown may be formed on the surface of a fluorescent film 10. A metal back is thus provided for the purpose of mirror-reflecting the light toward the rear plate 1 to the face plate 2, among light emitted from the fluorescent member, to improve the luminance, and for the purpose of protecting the fluorescent member against damages effected by collisions of negative ions generated in an envelope. However, the metal back can function as an electrode for applying an electron beam acceleration voltage, and then, the transparent electrode 8 is not particularly required in several cases. The present invention is applicable to any case.

A support frame 3 is connected with a rear plate 1 and a face plate 2, forming an envelope. The connection between the support frame 3 and the rear plate 1 and face plate 2 can be obtained by melting with use of a glass frit where glass is used, for example, although the connection depends on the material forming the support frame 3.

In addition, fixing of the spacer 11 to the face plate 2 and the rear plate 1 can be obtained by means of resin.

In the following the present invention will be clarified in detail by specific examples, but it is to be understood that the present invention is by no means limited by such examples and further includes replacements of components and modifications of designing within an extent that the objectives of the present invention are attained.

EXAMPLE 1

Figure 9:
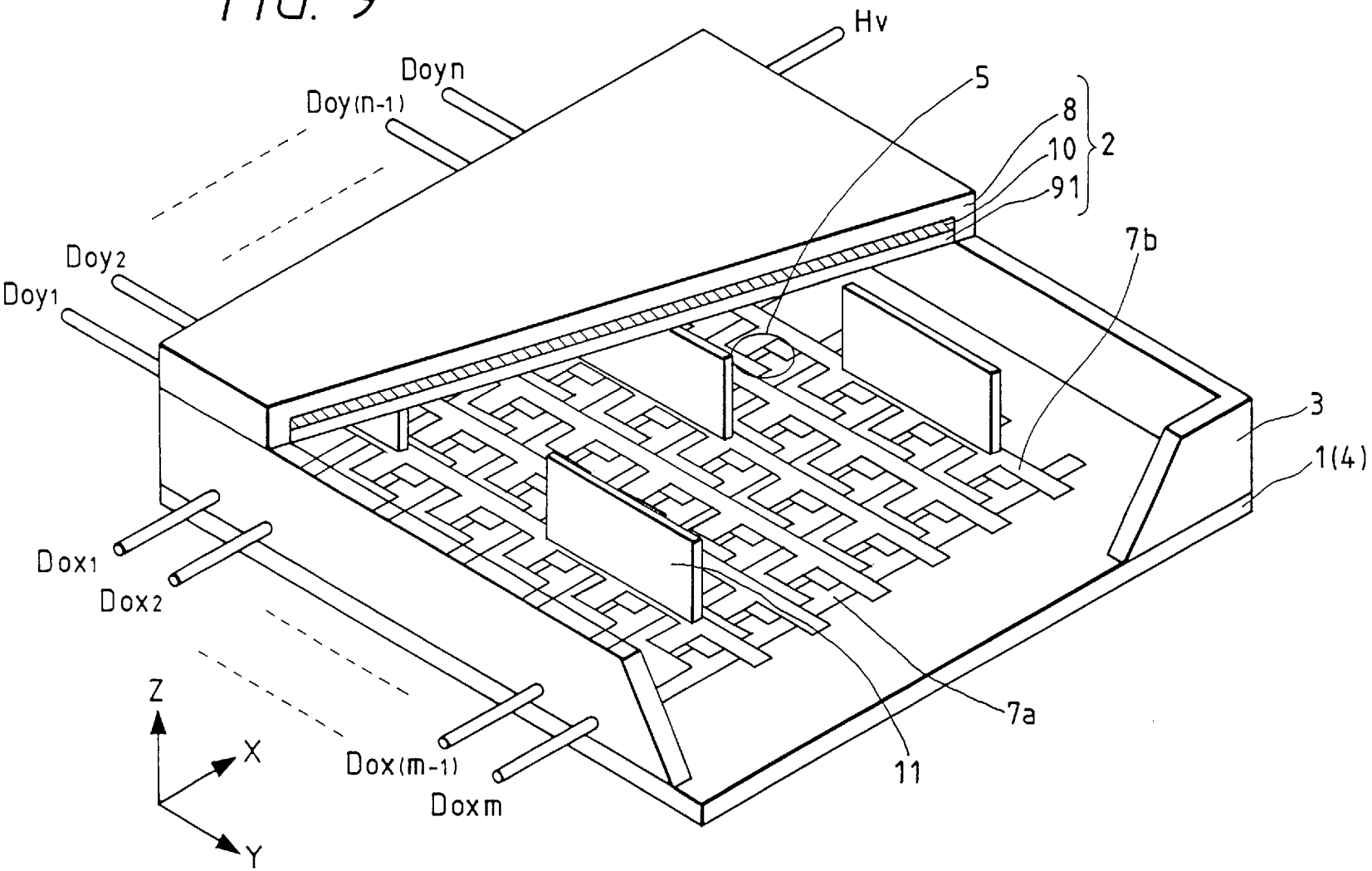
FIG. 9 is a cross-sectional view showing a flat image-forming apparatus according to the present invention.
Figure 10A:
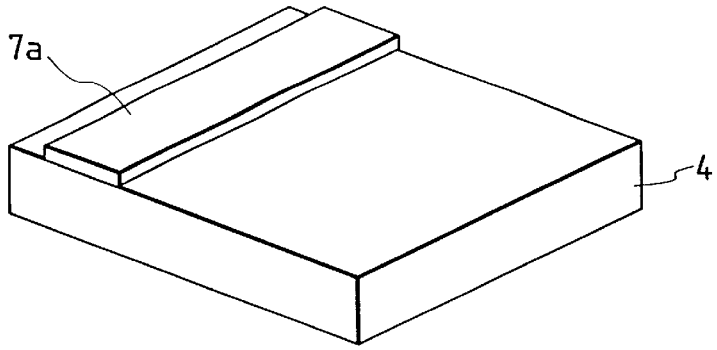
FIGS. 10A, 10B, 10C, 10D, 10E, 10F, 10G, and 10H are views showing a preparation process of an electron source using a surface conduction electron-emitting device prepared in an embodiment of the present invention.
Figure 10B:
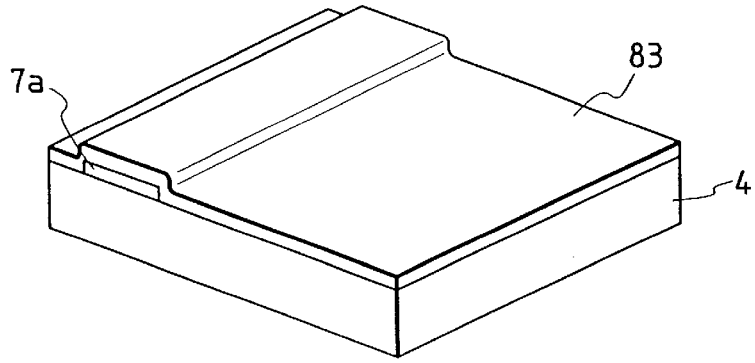
Figure 10C:
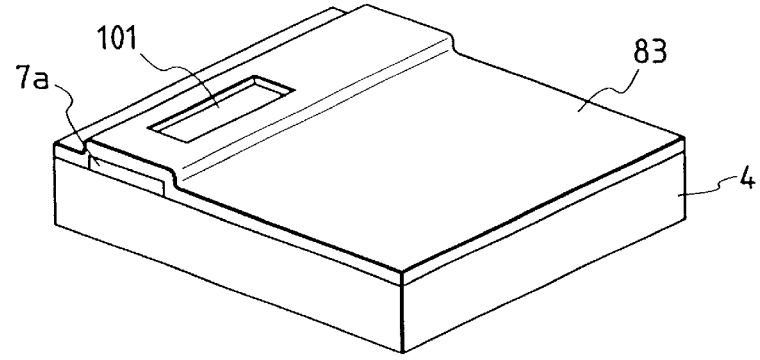
Figure 10D:
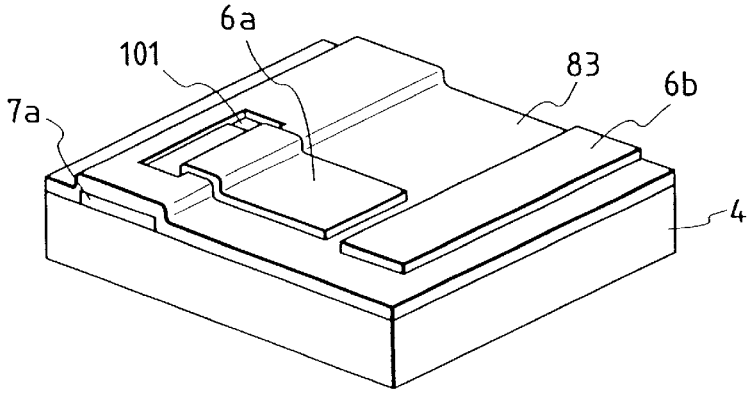
Figure 10E:
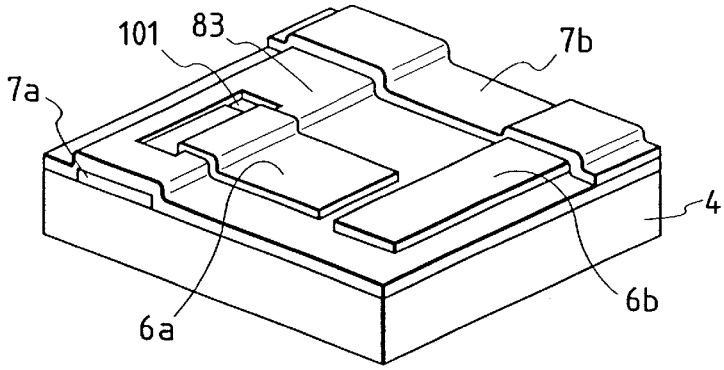
Figure 10F:
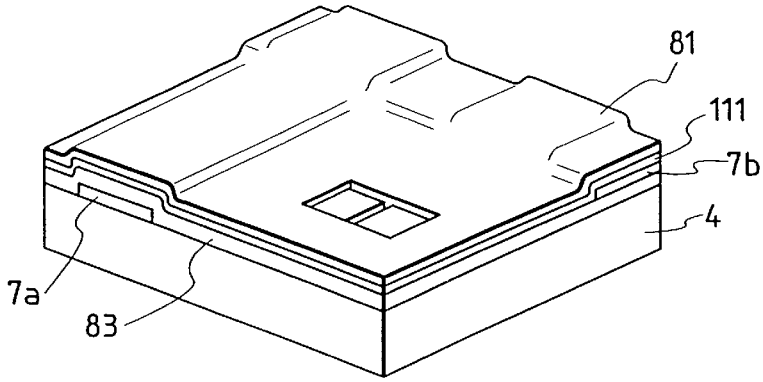
Figure 10G:
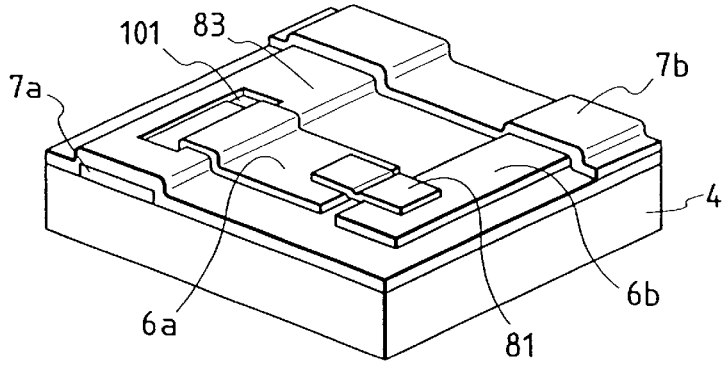
Figure 10H:
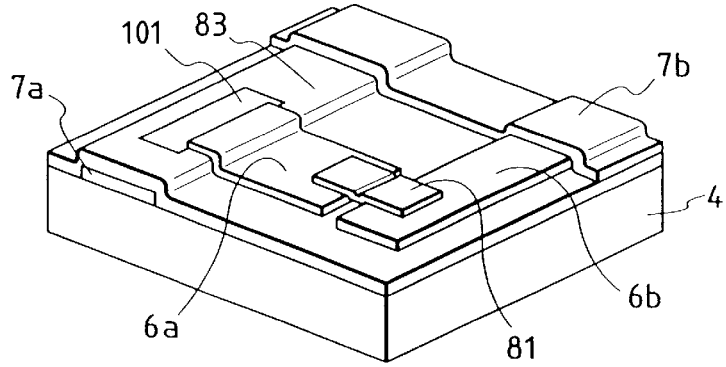

The basic configuration of the image forming apparatus of the present invention is same as that shown in FIGS. 1 and 2, and entire configuration is schematically shown in FIG. 9, wherein components same as those shown in FIGS. 1, 2 and 8 are represented by same numbers. A numeral 91 indicates a metal back.

The method for producing the image forming apparatus of the present invention is shown in FIGS. 10A to 10H. In the following there will be explained the basic configuration of the image forming apparatus of the present invention and the producing method thereof, with reference to FIGS. 9 and 10A to 10H. In this example, the substrate 4 per se functions as a rear plate, which is therefore denoted by reference 1 or 4 in FIGS. 10A to 10H and 11.

For the purpose of simplicity, FIGS. 10A to 10H show the preparation steps of an electron emitting device and the vicinity thereof, but the present example provides an image forming apparatus formed by a simple matrix arrangement of a plurality of surface conduction electron-emitting devices. FIGS. 10A to 10H respectively correspond to steps a to h explained in the following.

(step a)

On a substrate 4 obtained by forming an $SiO_2$ film of a thickness of 500 nm by sputtering on a cleaned soda-lime glass plate, a Cr film of a thickness of 5 nm and an Au film of a thickness of 600 nm were formed in succession by vacuum evaporation. Then photoresist (AZ1370 supplied by Hoechst Co.) was spin coated, baked, exposed of the image of a photomask and developed to obtain a resist pattern of an electrode wiring (lower wiring) 7*a*, and the Au/Cr deposition films were wet etched to obtain the lower wiring 7*a* of a desired shape.

(step b)

Then an interlayer insulation layer 83 consisting of an $SiO_2$ film of a thickness of 1.0 $\mu$m was deposited by RF sputtering.

(step c)

A photoresist pattern was formed for forming a contact hole 101 in the $SiO_2$ film deposited in the step b, and the interlayer insulation layer 83 was etched, utilizing the photoresist pattern as a mask, to form the contact hole 101. The etching was conducted by RIE (reactive ion etching) utilizing $CF_4$ and $H_2$ gasses.

(step d)

Then pattern for electrodes 6*a*, 6*b* was formed with photoresist (RD-2000N-41 supplied by Hitachi Chemical Co.), and a Ti film of a thickness of 5 nm and an Ni film of a thickness of 100 nm were deposited in succession by vacuum evaporation. The photoresist pattern was dissolved with an organic solvent, and the Ni/Ti deposited films were lifted off to form the electrodes 6*a*, 6*b*.

(step e)

A photoresist pattern for an electrode wiring (upper wiring) 7*b* was formed on the electrodes 6*a*, 6*b* then a Ti film of a thickness of 5 nm and an Au film of a thickness of 500 nm were deposited in succession by vacuum evaporation, and the unnecessary portion was lifted off to obtain the upper wiring 7*b* of a desired shape.

(step f)

A mask for an electroconductive thin film 81 of the electron emitting device to be used in this step had an aperture bridging the electrodes 6*a* and 6*b*. A Cr film 111 of a thickness of 100 nm was deposited by vacuum evaporation and patterned, utilizing such mask, and organic Pd solution (ccp4230 supplied by Okuno Pharmaceutical Co.) was spin coated thereon and baked for 10 minutes at 300° C. Thus formed electroconductive thin film 81, principally composed of fine Pd particles, had a film thickness of 10 nm and a sheet resistance of $5\times10^4\Omega/\square$.

(step g)

The Cr film 111 and the baked electroconductive thin film 81 were etched with an acid enchant to form desired patterns.

(step h)

A resist pattern was formed outside the portion of the contact hole 101, and a Ti film of a thickness of 5 nm and an Au film of a thickness of 500 nm are deposited in succession by vacuum evaporation. Then the unnecessary portion was eliminated by lifting off, whereby the contact hole 101 was filled in.

A rear plate 1 was formed through the above-explained steps.

In the following there will be explained the preparation of a spacer 11 to be employed in the present example.

(step i)

A small glass piece, cut and polished into a size of 1×40×0.2 mm (height×length×width, hereinafter represented in the same manner), was washed and was spin coated with polybenzimidazole varnish (PBI MR solution supplied by Toray Co.) diluted to twice volume with N,N-dimethylacetamide. The spin coating was at first made on one face (face of 1×40 mm) and the glass piece was prebaked for 10 minutes at 100° C. on a hot plate. Then the spin coating was made on the other face, and the glass piece was again prebaked for 10 minutes at 100° C. on the hot plate.

The coatings were cured by placing the coated glass piece in a clean oven, raising the temperature from the room temperature to 200° C., then maintaining the glass piece at 200° C. for 30 minutes, then raising the temperature to 300° C. and maintaining it for 1 hour at this temperature. The polybenzimidazole resin film thus obtained had a thickness of about 1 $\mu$m.

(step j)

In a position for placing the spacer on the upper wiring 7*b* of the rear plate 1, the PBI MR solution was coated with a dispenser, and the spacer 11 prepared in the step i was temporarily fixed. In this operation, the spacer 11 was supported substantially vertically by an unrepresented jig. The resin was prebaked for 10 minutes at 100° C. on a hot plate while the spacer was temporarily fixed and, after the removal of the jig for supporting the spacer, it was cured in a clean oven by raising the temperature from the room temperature to 200° C., then maintaining the temperature at 200° C. for 30 minutes, further raising the temperature to 300° C. and maintaining the temperature at 300° C. for 1 hour. In this manner the spacer 11 was fixed at the desired position on the rear plate 1.

It is also conceivable to position and fix the spacer on the face plate with an adhesive material or the like.

(step k)

On the rear plate 1 on which a plurality of spacers 11 were fixed in the above-explained manner, there was positioned a support frame 3. In this operation, frit glass was coated in advance on the adhering portion between the rear plate 1 and the support frame 3. A face plate 2 (prepared by forming a fluorescent film 10 and a metal back 91 on the internal face of a glass substrate 8) was placed on the support frame 3 and the spacers 11, and frit glass and PBI MR solution were coated in advance respectively on the adhering portion between the face plate 2 and the support frame 3 and that between the face plate 2 and the spacers 11.

The adhered composite of the rear plate 1, the support frame 3 and the face plate 2 was sealed, in the atmosphere, by treating for 10 minutes at 100° C., then raising the temperature to 200° C., maintaining this temperature for 30 minutes, then raising the temperature to 300° C., maintaining this temperature for 1 hour and baking the composite for 10 minutes at 400° C. (FIG. 9).

The fluorescent film 10 is composed solely of a fluorescent material in case of a monochromatic image, but, in the present example, was composed of fluorescent materials in stripe shapes. Black stripes were formed at first and the fluorescent materials for different colors were respectively filled in the gaps between the black stripes. The black stripes were formed with an already known material principally composed of graphite. The fluorescent materials were coated on the glass substrate 8 by the slurry method.

The metal back 91 on the internal face of the fluorescent film 10 was prepared, after the preparation of the fluorescent film, by smoothing (usually called filming) the internal surface of the fluorescent film and then depositing Al by vacuum evaporation.

The face plate 2 may be further provided with a transparent electrode on the external face of the fluorescent film 10 in order to enhance the electroconductivity thereof, but it was dispensed with in the present example since sufficient electroconductivity was obtained solely with the metal back.

In the sealing operation mentioned above, sufficient registration was executed since, in case of a color image, the fluorescent materials of respective colors have to be aligned with the electron emitting devices.

The atmosphere in this completed glass container was evacuated by a vacuum pump through an evacuating pipe (not shown), and, after a sufficient vacuum level was reached, a voltage was applied between the electrodes 6*a*, 6*b* through external terminals $D_{oxl}$–$D_{oxm}$ and $D_{oyl}$–$D_{oyn}$, thereby applying energization forming to the electroconductive thin films 81 to form a fissure therein. Then toluene was introduced through a slow leak valve and the evacuating pipe of the panel into the panel, and all the electron emitting devices 5 were driven in an atmosphere of $1.0\times10^{-5}$ Torr, thereby executing an activation treatment. The activation treatment is to form carbon in the above-mentioned fissure thereby significantly increasing the emission current (electrons), whereby formation of the electron emitting regions 82 is completed.

Then the interior was evacuated to a vacuum level of about $10^{-8}$ Torr, and the envelope was sealed by fusing the unrepresented evacuating pipe with a gas burner.

Finally, in order to maintain the vacuum after sealing, a getter treatment was conducted with high-frequency heating.

In the image forming apparatus of this example thus completed, an image was displayed by applying a scanning signal and a modulation signal from unrepresented signal generation means to the electron emitting devices through the external terminals $D_{oxl}$–$D_{oxm}$ and $D_{oyl}$–$D_{oyn}$ to induce electron emission and applying a high voltage Va to the metal back 91 through high voltage terminal Hv for accelerating the electron beams and causing the electrons to collide with the fluorescent materials, thereby inducing excitation and light emission.

In the image forming apparatus of the present example, in a range of the high voltage Va up to 7 kV, an image of high luminance and satisfactory color representation was obtained without any discharge or leak current. Also the image forming apparatus of the present example was constructed with a relatively low cost, since the spacer preparing step was simple.

EXAMPLE 2

In this example, the process was same as that in the example 1 up to the step h.

(step i)

In this example, a small glass piece, cut and polished into a size of 1×40×0.2 mm, was washed and was spin coated with aromatic polyimide varnish (Toreniece #3000 supplied by Toray Co.) diluted to twice volume with N-methyl-2-pyrrolidone. The spin coating was at first made on one face (face of 1×40 mm) and the glass piece was prebaked for 10 minutes at 100° C. on a hot plate. Then the spin coating was made on the other face, and the glass piece was again prebaked for 10 minutes at 100° C. on the hot plate. The coatings were cured by placing the coated glass piece in a clean oven, raising the temperature from the room temperature to 300° C., and maintaining the glass piece at 300° C. for 1 hour. The polyimide resin film thus obtained had a thickness of about 1 $\mu$m.

(step j)

In a position for placing the spacer on the upper wiring 7*b* of the rear plate 1, the Toreniece #3000 was coated with a dispenser, and the spacer 11 prepared in the step i was temporarily fixed. In this operation, the spacer 11 was supported substantially vertically by an unrepresented jig. The resin was prebaked for 10 minutes at 100° C. while the space was temporarily fixed, and, after the removal of the jig for supporting the spacer, it was cured in a clean oven by raising the temperature from the room temperature to 300° C., and maintaining the temperature at 300° C. for 1 hour.

In this manner the spacer 11 was fixed at the desired position on the rear plate 1.

(step k)

On the rear plate 1 on which a plurality of spacers 11 were fixed in the above-explained manner, there was positioned a support frame 3. In this operation, frit glass was coated in advance on the adhering portion between the rear plate 1 and the support frame 3. A face plate 2 (prepared by forming a fluorescent film 10 and a metal back 91 on the internal face of a glass substrate 8) was placed on the support frame 3 and the spacers 11, and frit glass and Toreniece #3000 were coated in advance respectively on the adhering portion between the face plate 1 and the support frame 3 and that between the face plate 2 and the spacers 11.

The adhered composite of the rear plate 1, the support frame 3 and the face plate 2 was sealed, in the atmosphere, by treating for 10 minutes at 100° C., then raising the temperature to 300° C. and maintaining this temperature for 1 hour, then raising the temperature to 400° C. and baking the composite for 10 minutes at 400° C. In the sealing operation mentioned above, sufficient registration was executed since, in case of a color image, the fluorescent materials of respective colors have to be aligned with the electron emitting devices.

The atmosphere in thus completed glass container was evacuated by a vacuum pump through an evacuating pipe, and, after a sufficient vacuum level was reached, the energization forming process and the activation process were conducted in the same manner as in the example 1.

Then, after the evacuation and sealing, the getter treatment was conducted with high-frequency heating.

In the image forming apparatus of this example thus completed, an image was displayed by causing the electron beams to collide with the fluorescent materials thereby inducing excitation and light emission.

In the image forming apparatus of the present example, in a range of the high voltage Va up to 7 kV, an image of high luminance and satisfactory color representation was obtained without any discharge or leak current phenomenon. Also the image forming apparatus of the present example was constructed with a relatively low cost, since the spacer preparing step was simple.

REFERENCE EXAMPLE 1

In this example, the process was same as that in the example 1 up to the step h.

(step i)

In this example, frit glass was coated with a dispenser in a position for placing the spacer on the upper wiring 7*b* of the rear plate 1, and a glass spacer 11, cut and polished into a size of 1×40×0.2 mm (without resin coating), was temporarily fixed thereon. In this operation, the spacer 11 was supported substantially vertically by an unrepresented jig. Then baking was conducted for 10 minutes at 400° C. in the air while the spacer was maintained in the temporarily fixed state.

(step j)

On the rear plate 1 on which a plurality of spacers 11 were fixed, there was positioned a support frame 3. In this operation, frit glass was coated in advance on the adhering portion between the rear plate 1 and the support frame 3. A face plate 2 (prepared by forming a fluorescent film 10 and a metal back 91 on the internal face of a glass substrate 8) was placed on the support frame 3 and the spacers 11, and frit glass was coated in advance on the adhering portion between the face plate 2 and the support frame 3 and that between the face plate 2 and the spacers 11.

The adhered composite of the rear plate 1, the support frame 3 and the face plate 2 was sealed by baking for 10 minutes at 400° C. in the air. In the sealing operation mentioned above, sufficient registration was executed since, in case of a color image, the fluorescent materials of respective colors have to be aligned with the electron emitting devices.

The atmosphere in thus completed glass container was evacuated by a vacuum pump through an evacuating pipe, and, after sufficient vacuum level was reached, the energization forming process and the activation process were conducted in the same manner as in the example 1.

Then, after the evacuation and the sealing, the getter treatment was conducted with high-frequency heating.

In the image forming apparatus of this reference example thus completed, an image was displayed by causing the electron beams to collide with the fluorescent materials, thereby inducing excitation and light emission as in the example 1.

In the image forming apparatus of the present reference example, a discharge was observed in the vicinity of the spacers 11 when the high voltage Va was raised to 2.2 kV. Consequently the image was evaluated by reducing Va to 2 kV, but the image showed a low luminance and was insufficient in the color representation.

EXAMPLE 3

In this example, the process was same as that in the example 1 up to the step h.

(step i)

In this example, a washed glass rod of a diameter of 0.2 mmϕ was dip coated with aromatic polyimide varnish (Toreniece #3000 supplied by Toray Co.) diluted to a volume of five times with N-methyl-2-pyrrolidone, by immersion and lifting of the glass rod in and from the liquid. The lifted glass rod was prebaked for 10 minutes at 100° C. in a clean oven, and the coating was cured by placing the glass rod in a clean oven, raising the temperature from the room temperature to 300° C., and maintaining this temperature for 1 hour. The polyimide resin film thus obtained had a thickness of about 1 $\mu$m.

The glass rod, thus superficially coated with polyimide resin, was cut into a length of 1 mm to obtain a plurality of cylindrical spacers 11.

(step j)

In a position for placing the spacer on the upper wiring 7*b* of the rear plate 1, the Toreniece #3000 was coated with a dispenser, and the spacer 11 prepared in the step i was temporarily fixed. In this operation, the spacer 11 was supported substantially vertically by an unrepresented jig. The resin was prebaked for 10 minutes at 100° C. while the spacer was temporarily fixed, and, after the removal of the jig for supporting the spacer, it was cured in a clean oven by raising the temperature from the room temperature to 300° C., and maintaining the temperature at 300° C. for 1 hour.

In this manner the spacer 11 was fixed at the desired position on the rear plate 1.

(step k)

On the rear plate 1 on which a plurality of spacers 11 were fixed in the above-explained manner, there was positioned a support frame 3. In this operation, frit glass was coated in advance on the adhering portion between the rear plate 1 and the support frame 3. A face plate 2 (prepared by forming a fluorescent film 10 and a metal back 91 on the internal face of a glass substrate 8) was placed on the support frame 3 and the spacers 11, and frit glass and Toreniece #3000 were coated in advance respectively on the adhering portion between the face plate 2 and the support frame 3 and that between the face plate 2 and the spacers 11.

The adhered composite of the rear plate 1, the support frame 3 and the face plate 2 were sealed, in the atmosphere, by treating for 10 minutes at 100° C., then raising the temperature to 300° C., maintaining this temperature for 1 hour, then raising the temperature to 400° C. and baking the composite for 10 minutes at 400° C. In the sealing operation mentioned above, sufficient registration was executed since, in case of a color image, the fluorescent materials of respective colors have to be aligned with the electron emitting devices.

The atmosphere in thus completed glass container was evacuated by a vacuum pump through an evacuating pipe, and, after a sufficient vacuum level was reached, the energization forming process and the activation process were conducted in the same manner as in the example 1.

Then, after the evacuation and the sealing, the getter treatment was conducted with high-frequency heating.

In the image forming apparatus of this example thus completed, an image was displayed by causing the electron beams to collide with the fluorescent material, thereby inducing excitation and light emission as in the example 1.

In the image forming apparatus of the present example, in a range of the high voltage Va up to 7 kV, an image of high luminance and satisfactory color representation was obtained without any discharge or leak current phenomenon. Also the image forming apparatus of the present example was constructed with a relatively low cost, since the spacer preparing step was simple

EXAMPLE 4

In this example, the process was same as that in the example 1 up to the step h.

(step i)

In this example, a small glass piece, cut and polished into a size of 1×40×0.2 mm, was washed and was spin coated with a mixture of aromatic polyimide varnish (Toreniece #3000 supplied by Toray Co.) diluted to twenty times with N-methyl-2-pyrrolidone and carbon black (furnace black) of an average particle size of 29 nm in an amount of 18 wt % to the Toreniece #3000 resin content. The spin coating was at first made on one face (face of 4×40 mm) and the glass piece was prebaked for 10 minutes at 100° C. on a hot plate. Then the spin coating was made on the other face, and the glass piece was again prebaked for 10 minutes at 100° C. on the hot plate. The coatings were cured by placing the coated glass piece in a clean oven, raising the temperature from the room temperature to 300° C., and maintaining the glass piece at 300° C. for 1 hour. The polyimide resin film thus obtained had a thickness of about 1 μm. Also the sheet resistance Rs of the spacer surface was $3\times10^{9}\Omega$.

(step j)

In a position for placing the spacer on the upper wiring 7*b* of the rear plate 1, a mixture of Toreniece #3000 and carbon black powder (furnace black) of a particle size of 29 nm in an amount of 30 wt % with respect to the Toreniece #3000 resin content was coated with a dispenser, and the spacer 11 prepared in the step i was temporarily fixed. In this operation the spacer 11 was supported substantially vertically by an unrepresented jig. Prebaking was conducted for 10 minutes at 100° C. while the spacer was temporarily fixed, and, after the removal of the jig for supporting the spacer, curing was conducted in a clean oven by raising the temperature from the room temperature to 300° C., and maintaining the temperature at 300° C. for 1 hour. In this manner the spacer 11 was fixed at the desired position on the rear plate 1.

(step k)

On the rear plate 1 on which a plurality of spacers 11 were fixed in the above-explained manner, there was positioned a support frame 3. In this operation, frit glass was coated in advance on the adhering portion between the rear plate 1 and the support frame 3. A face plate 2 (prepared by forming a fluorescent film 10 and a metal back 91 on the internal face of a glass substrate 8) was placed on the support frame 3 and the spacers 11, and frit glass and a mixture of Toreniece #3000 and carbon black powder (furnace black) in an amount of 30 wt % with respect to the Toreniece #3000 resin content were coated in advance respectively on the adhering portion between the face plate 2 and the support frame 3 and that between the face plate 2 and the spacers 11. The adhered composite of the rear plate 1, the support frame 3 and the face plate 2 was sealed, in the atmosphere, by treating for 10 minutes at 100° C., then raising the temperature to 300° C. and maintaining this temperature for 1 hour, then raising the temperature to 400° C. and baking the composite for 10 minutes at 400° C. In the sealing operation mentioned above sufficient registration was executed since, in case of a color image, the florescent materials respective colors have to be aligned with the electron emitting devices.

The atmosphere in thus completed glass container was evacuated by a vacuum pump through an evacuating pipe, and, after a sufficient vacuum level was reached, the energization forming process and the activation process were conducted in the same manner as in the example 1.

Then, after the evacuation and the sealing, the getter treatment was conducted with high-frequency heating.

In the image forming apparatus of this example thus completed, an image was displayed by causing the electron beams to collide with the fluorescent materials, thereby inducing excitation and light emission as in the example 1.

In the image forming apparatus of the present example, in a range of the high voltage Va up to 15 kV, an image of extremely high luminance and satisfactory color representation was obtained in stable manner, without any discharge or leak current phenomenon. Also the image forming apparatus of the present example was constructed with a relative low cost, since the spacer preparing step was simplified.

EXAMPLE 5

In this example, the process was same as that in the first example up to the step h.

(step i)

In this example, a small glass piece, cut and polished into a size of 4×40×0.2 mm, was washed and was spin coated with a mixture of polybenzimidazole varnish (PBI MR solution supplied by Toray Co.) diluted to twice volume with N,N-dimethylacetamide and natural graphite powder of a particle size of 100 nm in an amount of 20 wt % with respect to the resin content of the PBI MR solution. The spin coating was at first made on one face (face of 1×40 mm) and the glass piece was prebaked for 10 minutes at 100° C. on a hot plate. Then the spin coating was made on the other face, and the glass piece was again prebaked for 10 minutes at 100° C. on the hot plate. The coatings were cured by placing the coated glass piece in a clean oven, raising the temperature from the room temperature to 200° C., then maintaining the glass piece at 200° C. for 30 minutes, then raising the temperature to 300° C. and maintaining the temperature at 300° C. for 1 hour. The graphite-containing polybenzimidazole resin film thus obtained had a thickness of about 1 μm. Also the sheet resistance Rs at the spacer surface was $1\times10^{10}\Omega/\square$.

(step j)

In a position for placing the spacer on the upper wiring 7*b* of the rear plate 1, a mixture of the PBI MR solution and natural graphite powder of a particle size of 100 nm in an amount of 30 wt % with respect to the resin content of the PBI MR solution was coated with a dispenser, and the spacer 11 prepared in the step i was temporarily fixed. In this operation, the spacer 11 was supported substantially vertically by an unrepresented jig. The resin was prebaked for 10 minutes at 100° C. while the spacer was temporarily fixed, and, after the removal of the jig for supporting the spacer, it was cured in a clean oven by raising the temperature from the room temperature to 200° C., then maintaining the temperature at 200° C. for 30 minutes, further raising the temperature to 300° C. and maintaining the temperature at 300° C. for 1 hour. In this manner the spacer 11 was fixed at the desired position on the rear plate 1.

(step k)

On the rear plate 1 on which a plurality of spacers 11 were fixed in the above-explained manner, there was positioned a support frame 3. In this operation, frit glass was coated in advance on the adhering portion between the rear plate 1 and the support frame 3. A face plate 2 (prepared by forming a fluorescent film 10 and a metal back 91 on the internal face of a glass substrate 8) was placed on the support frame 3 and the spacers 11, and frit glass and a mixture of the PBI MR solution and natural graphite powder of a particle size of 100 nm in an amount of 30 wt % with respect to the resin content of the PBI MR solution were respectively coated in advance on the adhering portion between the face plate 2 and the support frame 3 and that between the face plate 2 and the spacers 11. The adhered composite of the rear plate 1, the support frame 3 and the face plate 2 was sealed, in the air, by treating for 10 minutes at 100° C., then raising the temperature to 200° C., maintaining this temperature for 30 minutes, then raising the temperature to 300° C., maintaining this temperature for 1 hour and baking the composite for 10 minutes at 400° C. In the sealing operation mentioned above, sufficient registration was executed since, in case of a color image, the fluorescent materials of respective colors have to be aligned with the electron emitting devices.

The atmosphere in thus completed glass container was evacuated by a vacuum pump through an evacuating pipe, and, after a sufficient vacuum level was reached, the energization forming process and the activation process were conducted in the same manner as in the example 1.

Then, after the evacuation and the sealing, the getter treatment was conducted with high-frequency heating.

In the image forming apparatus of this example thus completed, an image could be displayed by causing the electron beams to collide with the fluorescent materials, thereby inducing excitation and light emission as in the example 1.

In the image forming apparatus of the present example, in a range of the high voltage Va up to 20 kV, an image of extremely high luminance and satisfactory color representation was obtained in stable manner, without any discharge or leak current phenomenon. Also the image forming apparatus of the present example was constructed with a relatively low cost, since the spacer preparing step was simplified.

REFERENCE EXAMPLE 2

In this example, the process was same as that in the example 1 up to the step h.

(step i)

Frit glass was coated with a dispenser in a position for placing the spacer on the upper wiring 7*b* of the rear plate 1, a glass spacer 11, cut and polished into a size of 4×40×0.2 mm (without resin coating), was temporarily fixed thereon. In this operation, the spacer 11 was supported substantially vertically by an unrepresented jig. Then baking was conducted for 10 minutes at 400° C. in the air while the spacer was maintained in the temporarily fixed state.

(step j)

On the rear plate 1 on which a plurality of spacers 11 were fixed, there was positioned a support frame 3. In this operation, frit glass was coated in advance on the adhering portion between the rear plate 1 and the support frame 3. A face plate 2 (prepared by forming a fluorescent film 10 and a metal back 91 on the internal face of a glass substrate 8) was placed on the support frame 3 and the spacers 11, and frit glass was coated in advance on the adhering portion between the face plate 2 and the support frame 3 and that between the face plate 2 and the spacers 11. The adhered composite of the rear plate 1, the support frame 3 and the face plate 2 was sealed by baking for 10 minutes at 400° C. in the air. In the sealing operation mentioned above, sufficient registration was executed since, in case of a color image, the fluorescent materials of respective colors have to be aligned with the electron emitting devices.

The atmosphere in thus completed glass container was evacuated by a vacuum pump through an evacuating pipe, and, after a sufficient vacuum level was reached, the energization forming process and the activation process were conducted in the same manner as in the example 1.

Then, after the evacuation and the sealing, the getter treatment was conducted with high-frequency heating.

In the image forming apparatus of this example thus completed, an image was displayed by causing the electron beams to collide with the fluorescent material, thereby inducing excitation and light emission as in the example 1.

In the image forming apparatus of the present example, in a range of the high voltage Va up to 8 kV, an image of high luminance and satisfactory color representation was obtained without any discharge or leak current phenomenon. However stable display could not be obtained as the image in the vicinity of the spacer was distorted in several minutes.

Also in the course of a gradual rise of the high voltage Va, a discharge phenomenon was obtained at about 12 kV and the image in the vicinity of the spacer suddenly became darker.

EXAMPLE 6

In this example, the process was same as that in the example 1 up to the step h.

(step i)

In this example, glass fiber-reinforced polyimide resin (trade name AURUM JGN3030 supplied by Mitsui Toatsu Chemical Co.) was formed by injection molding into a spacer of 1×40×0.2 mm, which was degassed by heating for 1 hour at 300° C. in a clean oven.

(step j)

In a position for placing the spacer on the upper wiring 7*b* of the rear plate 1, aromatic polyimide varnish (Toreniece #3000 supplied by Toray Co.) was coated with a dispenser, and the spacer 11 prepared in the step i was temporarily fixed. In this operation, the spacer 11 was supported substantially vertically by an unrepresented jig. The resin was prebaked for 10 minutes at 100° C. while the spacer was temporarily fixed, and, after the removal of the jig for supporting the spacer, degassing was conducted in a clean oven by raising the temperature from the room temperature to 300° C., and maintaining the temperature at 300° C. for 1 hour. In this manner the spacer 11 was fixed in the desired position on the rear plate 1.

(step k)

On the rear plate 1 on which a plurality of spacers 11 were fixed in the above-explained manner, there was positioned a support frame 3. In this operation, frit glass was coated in advance on the adhering portion between the rear plate 1 and the support frame 3. A face plate 2 (prepared by forming a fluorescent film 10 and a metal back 91 on the internal face of a glass substrate 8) was placed on the support frame 3 and the spacers 11, and frit glass was coated in advance on the adhering portion between the face plate 2 and the support frame 3 and that between the face plate 2 and the spacers 11. The adhered composite of the rear plate 1, the support frame 3 and the face plate 2 was sealed, in the air, by treating for 10 minutes at 100° C., then raising the temperature to 300° C., maintaining this temperature for 1 hour, then raising the temperature to 400° C. and baking the composite for 10 minutes at 400° C. In the sealing operation mentioned above, sufficient registration was executed since, in case of a color image, the fluorescent materials of respective colors have to be aligned with the electron emitting device.

The atmosphere in thus completed glass container was evacuated by a vacuum pump through an evacuating pipe, and, after a sufficient vacuum level was reached, the energization forming process and the activation process were conducted in the same manner as in the example 1.

Then, after the evacuation and the sealing, the getter treatment was conducted with high-frequency heating.

In the image forming apparatus of this example thus completed, an image was displayed by causing the electron beams to collide with the florescent material, thereby inducing excitation and light emission as in the example 1.

In the image forming apparatus of the present example, in a range of the high voltage Va up to 7 kV, an image of high luminance and satisfactory color representation was obtained without any discharge or leak current phenomenon.

Also the image forming apparatus of the present example was constructed with a relatively low cost, since the spacer preparing step was simple.

EXAMPLE 7

In this example, the process was same as that in the example 1 up to the step h.

(step i)

In this example, carbon fiber-reinforced polyimide resin (trade name AURUM JCN3030 supplied by Mitsui Toatsu Chemical Co.) was formed by injection molding into a spacer of 4×40×0.2 mm, and the spacer was degassed by heating for 1 hour at 300° C. in a clean oven as in the example 6.

(step j)

Then, thus prepared spacer was fixed on the rear plate as in the example 6.

(step k)

On the rear plate 1 on which a plurality of spacers 11 were fixed in the above-explained manner, there was positioned a support frame 3. In this operation, frit glass was coated in advance on the adhering portion between the rear plate 1 and the support frame 3. A face plate 2 (prepared by forming a fluorescent film 10 and a metal back 91 on the internal face of a glass substrate 8) was placed on the support frame 3 and the spacers 11, and frit glass and Toreniece #3000 were respectively coated in advance on the adhering portion between the face plate 2 and the support frame 3 and that between the face plate 2 and the spacers 11. The adhered composite of the rear plate 1, the support frame 3 and the face plate 2 was sealed, in the air, by treating for 10 minutes at 100° C., then raising the temperature to 200° C., maintaining this temperature for 30 minutes, then raising the temperature to 300° C., maintaining this temperature for 1 hour, then raising the temperature to 400° C. and baking the composite for 10 minutes at 400° C. In the sealing operation mentioned above, sufficient registration was executed since, in case of a color image, the fluorescent materials of respective colors have to be aligned with the electron emitting devices.

The atmosphere in thus completed glass container was evacuated by a vacuum pump through an evacuating pipe, and, after a sufficient vacuum level was reached, the energization forming process and the activation process were conducted in the same manner as in the example 1.

Then, after the evacuation and the sealing, the getter treatment was conducted with high-frequency heating.

In the image forming apparatus of this example thus completed, an image was displayed by causing the electron beams to collide with the fluorescent material, thereby inducing excitation and light emission as in the example 1.

In the image forming apparatus of the present example, in a range of the high voltage Va up to 15 kV, an image of high luminance and satisfactory color representation was obtained in stable manner without any discharge or leak current phenomenon.

Also the image forming apparatus of the present example was constructed with a relatively low cost, since the spacer preparing step was simplified.

EXAMPLE 8

In this example, the process was same as in the example 1 up to the step h.

(step i)

In this example, glass fiber-reinforced polyimide resin (trade name AURUM JGN3030 supplied by Mitsui Toatsu Chemical Co.) was formed by injection molding into a spacer of 4×40×0.2 mm, and the spacer was degassed by heating for 1 hour at 300° C. in a clean oven. A mixture of aromatic polyimide varnish (Toreniece #3000 supplied by Toray Co.) was diluted twenty times with N-methyl-2-pyrrolidone and carbon black (furnace black) of an average particle size of 29 nm in an amount of 18 wt % to the Toreniece #3000 resin content. The spin coating was at first made on one face (face of 4×40 mm) and the resin piece was prebaked for 10 minutes at 100° C. on a hot plate. Then the spin coating was made on the other face, and the resin piece was again prebaked for 10 minutes at 100° C. on the hot plate. The coatings were cured by placing the coated resin piece in a clean oven, raising the temperature from the room temperature to 300° C., and maintaining this temperature for 1 hour. The polyimide resin film thus obtained had a thickness of about 0.1 $\mu$m. Also the sheet resistance Rs of the spacer surface was $3\times10^9\Omega/\square$.

(step j)

In a position for placing the spacer on the upper wiring 7*b* of the rear plate 1, a mixture of Toreniece #3000 and carbon black powder (furnace black) of a particle size of 29 nm in an amount of 30 wt % with respect to the Toreniece #3000 resin content was coated with a dispenser, and the spacer 11 prepared in the step i was temporarily fixed. In this operation, the spacer 11 was supported substantially vertically by an unrepresented jig. Prebaking was conducted for 10 minutes at 100° C. while the spacer was temporarily fixed, and, after the removal of the jig for supporting the spacer, curing was conducted in a clean oven by raising the temperature from the room temperature to 300° C., and maintaining this temperature for 1 hour. In this manner the spacer 11 was fixed at the desired position on the rear plate 1.

(step k)

On the rear plate 1 on which a plurality of spacers 11 were fixed in the above-explained manner, there was positioned a support frame 3. In this operation, frit glass was coated in advance on the adhering portion between the rear plate 1 and the support frame 3. A face plate 2 (prepared by forming a fluorescent film 10 and a metal back 91 on the internal face of a glass substrate 8) was placed on the support frame 3 and the spacers 11, and frit glass and a mixture of Toreniece #3000 and carbon black powder (furnace black) of a particle size of 29 nm in an amount of 30 wt % with respect to the Toreniece #3000 resin content were respectively coated in advance on the adhering portion between the face plate 2 and the support frame 3 and that between the face plate 2 and the spacers 11. The adhered composite of the rear plate 1, the support frame 3 and the face plate 2 was sealed, in the air, by treating for 10 minutes at 100° C., then raising the temperature to 300° C., maintaining this temperature for 1 hour, then raising the temperature to 400° C. and baking the composite for 10 minutes at 400° C. In this sealing operation mentioned above, sufficient registration was executed since, in case of a color image, the fluorescent materials of respective colors have to be aligned with the electron emitting devices.

The atmosphere in thus completed glass container was evacuated by a vacuum pump through an evacuating pipe, and, after a sufficient vacuum level was reached, the energization forming process and the activation process were conducted in the same manner as in the example 1.

Then, after the evacuation and the sealing, the getter treatment was conducted with high-frequency heating.

In the image forming apparatus of this example thus completed, an image was displayed by causing the electron beams to collide with the florescent materials, thereby inducing excitation and light emission as in the example 1.

In the image forming apparatus of the present example, in a range of the high voltage Va up to 15 kV, an image of extremely high luminance and satisfactory color representation was obtained in stable manner, without any discharge or leak current phenomenon. Also the image forming apparatus of the present example was constructed with a relatively low cost, since the spacer preparing step was simplified.

EXAMPLE 9

This example shows the preparation of the spacer of a configuration shown in FIG. 5A.

In this example, the process was same as that in the example 1 up to the step h.

(step i)

In this example, a small glass piece, cut and polished into a size of 4×40×0.2 mm, was washed and was immersed in and then lifted from aromatic polyimide varnish (Toreniece #3000 supplied by Toray Co.) diluted five times in volume with N-methyl-2-pyrrolidone. The coating was cured by placing the coated glass piece in a clean oven, raising the temperature from the room temperature to 300° C., and maintaining this temperature for 1 hour. Heating was further conducted for 1 hour at 520° C. In thus obtained spacer, the organic resin was carbonized. Also the sheet resistance Rs of the spacer surface was $5\times10^9$ Ω/□. The cross-sectional observation of the spacer taken out from the vacuum chamber revealed a laminate structure of a carbon layer and a polyimide resin layer as shown in FIGS. 5A and 5B, with a thickness of the carbon layer of ca. 270 nm and a thickness of the polyimide resin layer of 300 nm. The initial film thickness of the polyimide resin layer was 600 nm. This indicates that the film thickness loss resulting from the carbonizing of the polyimide resin is 10%. The contents of oxygen and nitrogen in the carbon layer, measured by Rutherford backscattering spectrometry, were respectively 12% and 5%, which were not significantly decreased from those in the raw material. Also ESCA observation revealed that the carbon layer was polymer obtained by thermal decomposition of the raw material. On both end faces of the spacer, coming into contact with the face plate and the rear plate, the organic resin was further carbonized by laser irradiation to form electrical contact layers.

(step j)

In a position for placing the spacer on the upper wiring 7*b* of the rear plate 1, a mixture of PBI MR solution and natural graphite powder of a particle size of 100 nm, in an amount of 30 wt % with respect to the resin content of the PBI MR solution, was coated with a dispenser, and the spacer 11 prepared in the step i was temporarily fixed. In this operation, the spacer 11 was supported substantially vertically by an unrepresented jig. The resin was prebaked for 10 minutes at 100° C. while the spacer was temporarily fixed, and, after the removal of the jig for supporting the spacer, it was cured in a clean oven by raising the temperature from the room temperature to 200° C., maintaining this temperature for 20 minutes, then raising the temperature to 300° C. and maintaining this temperature for 1 hour. In this manner the spacer 11 was fixed at the desired position on the rear plate 1.

(step k)

On the rear plate 1 on which a plurality of spacers 11 were fixed in the above-explained manner, there was positioned a support frame 3. In this operation, frit glass was coated in advance on the adhering portion between the rear plate 1 and the support frame 3. A face plate 2 (prepared by forming a fluorescent film 10 and a metal back 91 on the internal face of a glass substrate 8) was placed on the support frame 3 and the spacers 11, and frit glass and a mixture of the PBI MR solution and natural graphite powder of a particle size of 100 nm, in an amount of 30 wt % with resect to the resin content of the PBI MR solution, were respectively coated in advance on the adhering portion between the face plate 2 and the support frame 3 and that between the face plate 2 and the spacers 11. The adhered composite of the rear plate 1, the support frame 3 and the face plate 2 was sealed, in the air, by treating for 10 minutes at 100° C., then raising the temperature to 200° C., maintaining this temperature for 30 minutes, then raising the temperature to 300° C., maintaining this temperature for 1 hour, then raising the temperature to 400° C. and baking the composite for 10 minutes at 400° C. In the sealing operation mentioned above, sufficient registration was executed since, in case of a color image, the fluorescent materials of respective colors have to be aligned with the electron emitting devices.

The atmosphere in thus completed glass container was evacuated by a vacuum pump through an evacuating pipe, and, after a sufficient vacuum level was reached, the energization forming process and the activation process were conducted in the same manner as in the example 1.

Then, after the evacuation and the sealing, the getter treatment was conducted with high-frequency heating.

In the image forming apparatus of this example thus completed, an image was displayed by causing the electron beams to collide with the fluorescent material, thereby inducing excitation and light emission.

In the image forming apparatus of the present example, in a range of the high voltage Va up to 17 kV, an image of extremely high luminance and satisfactory color representation was obtained in stable manner without any discharge or leak current other than a current resulting from the resistance of the spacers and the anode voltage. It is estimated that the use of carbon with a limited secondary electron emission efficiency increased the discharge breakdown voltage and suppressed the charging. Also the image forming apparatus of the present example was constructed with a relatively low cost, since the spacer preparing step was simplified.

EXAMPLE 10

In this example, the process was same as that in the example 1 up to the step h.

In the following there will be explained the preparation of the spacer in the present example. The spacer has a structure shown in FIG. 5B, containing a carbon layer and a resin layer laminated on a spacer substrate. In this example, glass fiber-reinforced polyimide resin (trade name AURUM JGN 3030 supplied by Mitsui Toatsu Chemical Co.) was formed by injection molding into a spacer of 4×40×0.2 mm.

(step i)

A spacer of 4×40×0.2 mm, formed with glass fiber-reinforced polyimide resin (trade name AURUM JGN 3030 supplied by Mitsui Toatsu Chemical Co.) by injection molding, was spin coated with aromatic polyimide varnish (Toreniece #3000 supplied by Toray Co.) diluted to twice volume with N-methyl-2-pyrrolidone. The spin coating was at first made on a face (face of 4×40 mm) and the prebaking was conducted for 10 minutes at 100° C. on a hot plate. Then the spin coating was made on the other face, and the prebaking was conducted again for 10 minutes at 100° C. on the hot plate. The coatings were cured by placing the coated piece in a clean oven, raising the temperature from the room temperature to 300° C., and maintaining this temperature for 1 hour. The polyimide resin film thus obtained had a thickness of about 1 μm. Then the spacer was placed in a vacuum chamber and the polyimide resin coated on the spacer was uniformly irradiated with an electron beam, emitted from an electron gun with an electron density of $10^{15}$ electrons/cm$^2$ and an acceleration of 50 V. In thus obtained spacer, the organic resin was carbonized. Also the sheet resistance Rs of the spacer surface was $10^{10}$ Ω/□. The cross-sectional observation of the spacer taken out from the vacuum chamber revealed a laminate structure of a carbon layer and a polyimide resin layer as shown in FIG. 5B. The carbon layer in this case consisted of fine graphite particles dispersed in localized point-shaped recesses formed on the surface of the polyimide resin. Prior to the electron beam irradiation mentioned above, the influence on the carbonizing of the polyimide resin was investigated in advance as functions of the density and the acceleration energy of the electron beam. As a result, it was revealed that the thickness of the carbon layer can be varied by the acceleration energy of the electron beam and the electron density. More specifically, an increase or decrease in the acceleration energy or the electron density of the electron beam respectively increases or decreases the thickness of the carbon layer. The above-mentioned conditions were selected to decrease the electron density and to form conductive fine carbon particles on the outermost layer, thereby obtaining a high surface resistance.

On both end faces of the spacer, coming into contact with the face plate and the rear plate, the organic resin was further carbonized by laser irradiation to form electrical contact layers.

The subsequent steps were conducted as in the example 9 to complete the image forming apparatus.

In the image forming apparatus of this example thus completed, an image was displayed by causing the electron beams to collide with the fluorescent materials, thereby inducing excitation and light emission as in the example 1.

In the image forming apparatus of the present example, in a range of the high voltage Va up to 17 kV, an image of high luminance and satisfactory color representation was obtained in stable manner without any discharge or leak current other than a current based on the spacer resistance and the anode voltage.

EXAMPLE 11

This example shows the preparation of the spacer of a configuration shown in FIG. 7C, in which a catalytic metal is formed in a desired pattern whereby a carbon layer is formed selectively and partially.

In this example, the process was same as that of the example 1 up to the step h.

(step i)

In this example, a small glass piece, cut and polished into a size of 4×40×0.2 mm, was washed, then was immersed in and lifted from polybenzimidazole varnish (PBI MR solution supplied by Toray Co.) diluted to twice volume with N,N-dimethylacetamide. Then solvent was removed by procuring for 20 minutes at 100° C. in an oven, and these steps were repeated. Then the coating was cured by placing the coated glass piece in a clean oven, raising the temperature from the room temperature to 200° C., then maintaining this temperature for 30 minutes, then raising the temperature to 300° C. and maintaining this temperature for 1 hour. On the organic resin of thus prepared spacer, solution of nickel formate was applied by ink jet method in a stripe shape of a width of 50 μm, so as to correspond to a pattern shown in FIG. 6A, having a pitch P=70 μm and a recess width 1=50 μm. Then heating was conducted for 30 minutes at 350° C. in nitrogen gas to decompose nickel format, thereby forming a stripe-shaped fine nickel metal particle layer on both faces of the spacer substrate. Heating was further conducted for 30 minutes at 470° C. in an infrared oven. In thus obtained spacer, carbonizing took place in the portion of deposition of nickel formate, whereby a carbon layer 52 and a polybenzimidazole resin layer 51 were alternatively repeated in stripe shape with respective widths of 50 and 20 μm. The polybenzimidazole resin layer and the carbon layer had thicknesses of about 10 and 8 μm respectively. Polybenzimidazole resin remained slightly between the carbon layer and the spacer substrate. The Raman microspectroscopy of the carbon layer mainly detected graphite peaks.

The subsequent steps were conducted as in the example 9 to complete the image forming apparatus.

In the image forming apparatus of this example thus completed, an image was displayed by causing the electron beams to collide with the fluorescent materials, thereby inducing excitation and light emission as in the example 1.

In the image forming apparatus of the present example, in a range of the high voltage Va up to 21 kV, an image of extremely high luminance and satisfactory color representation was obtained in stable manner without any discharge or leak current. This result is presumably attributable to an increase in the discharge breakdown voltage, because of an increase of the distance along the surface resulting from the formation of surface irregularities and a secondary electron emission efficiency substantially close to unity resulting from the presence of carbon layer in the recesses. Further, since 1 and P satisfied the relations l>P/2 and P<200 μm, deviation of electron beams due to charged spacers was minimized.

Also the image forming apparatus of the present example was constructed with a relatively low cost, since the spacer preparing step was simplified.

EXAMPLE 12

This example shows the preparation of the spacer of a configuration shown in FIG. 7B, in which a catalytic metal is formed in a desired pattern whereby a carbon layer is formed selectively and partially.

In this example, the process was same as that of the example 1 up to the step h.

(step i)

In this example, a small glass piece, cut and polished into a size of 4×40×0.2 mm, was washed, then solution of nickel formate was applied onto thus prepared spacer substrate by an ink jet method in stripes of a width of 50 μm so as to correspond to the pitch P=70 μm and the recess width 1=50 μm shown in FIG. 6A and the substrate was baked at 350° C. in nitrogen atmosphere. Then the spacer substrate was immersed in and lifted from polybenzimidazole varnish (PBI MR solution supplied by Toray Co.) diluted to twice volume with N,N-dimethylacetamide. Then solvent was removed by procuring for 20 minutes at 100° C. in an oven, and these steps were repeated. Then the coating was cured by placing the coated glass piece in a clean oven, raising the temperature from the room temperature to 200° C., then maintaining this temperature for 30 minutes, again raising the temperature to 300° C. and maintaining this temperature for 1 hour. On the organic resin of thus prepared spacer, solution of nickel formate was applied in stripes of a width of 50 μm, so as to correspond to the deposited fine nickel metal particles. Then heating was conducted for 30 minutes at 350° C. in nitrogen gas to decompose nickel formate, thereby forming a stripe-shaped fine nickel metal particle layer on both faces of the spacer substrate. Heating was further conducted for 30 minutes at 470° C. in an infrared oven. In thus obtained spacer, carbonizing took place in the portion of deposition of nickel formate, whereby a carbon layer 52 and a polybenzimidazole resin layer 51 were alternately repeated in stripe shape with respective widths of 50 and 20 μm. The polybenzimidazole resin layer and the carbon layer had thicknesses of about 10 and 7 μm respectively. Polybenzimidazole resin was not present between the carbon layer and the spacer substrate.

The subsequent steps were conducted as in the example 9 to complete the image forming apparatus.

In the image forming apparatus of this example thus completed, an image was displayed by causing the electron beams to collide with the fluorescent materials, thereby inducing excitation and light emission as in the example 1.

In the image forming apparatus of the present example, in a range of the high voltage Va up to 21 kV, an image of extremely high luminance and satisfactory color representation was obtained in stable manner without any discharge or leak current. This result is presumably attributable to an increase in the-discharge breakdown voltage, because of an increase of the distance along the surface resulting from the formation of surface irregularities and a secondary electron emission efficiency substantially close to unity resulting from the presence of carbon layer in the recesses.

EXAMPLE 13

This example shows the preparation of the spacer of a configuration shown in FIG. 6A, in which a catalytic metal is formed in a desired pattern to selectively and partially form a carbon layer, and a carbon layer is also formed on the protruding face of the resin layer.

In this example, the process was same as that of the example 1 up to the step h.

(step i)

In this example, a small glass piece, cut and polished into a size of 4×40×0.2 mm, was washed, then aqueous solution of nickel formate was applied onto thus prepared spacer substrate by an ink jet method in stripes of a width of 100 μm so as to correspond to the pitch P=180 μm and the recess width 1=100 μm shown in FIG. 6A. Then the substrate was baked for 30 minutes at 350° C. in nitrogen atmosphere to decompose nickel formate, thereby forming a stripe-shaped fine nickel metal particle layer on both surfaces of the spacer substrate. Then thus prepared spacer substrate was immersed in and lifted from polybenzimidazole varnish (PBI MR solution supplied by Toray Co.) diluted to twice volume with N,N-dimethylacetamide. Then solvent was removed by procuring for 20 minutes at 100° C. in an oven, and these steps were repeated. Then the coating was cured by placing the coated glass piece in a clean oven, raising the temperature from the room temperature to 200° C., then maintaining this temperature for 30 minutes, again raising the temperature to 300° C. and maintaining this temperature for 1 hour. Heating was further conducted for 30 minutes at 470° C. in an infrared oven. Then thus obtained spacer, on which the carbon layers 52 and the polybenzimidazole resin layer 51 were alternated in stripes, was placed in a vacuum chamber as in the example 10 and the entire spacer surface was uniformly irradiated with an electron beam, emitted from an electron gun with an electron density of $10^{15}$ electrons/cm$^2$ and an acceleration of 40 V, whereby this carbonizing took place also on the surface of the protruding polybenzimidazole resin layer 51. On both end faces of the spacer, coming into contact with the face plate and the rear plate, metallic Pt was formed as electrical contact layers.

In thus obtained spacer, a carbon layer 52 and a polybenzimidazole resin layer 51 were alternately repeated in stripe shape with respective widths of 80 and 100 μm, with respective thicknesses of about 10 and 8 μm. Also the sheet resistance Rs of the spacer surface was $5\times10^9\Omega/\square$.

(step j)

The subsequent steps were conducted as in the example 9 to complete the image forming apparatus.

In the image forming apparatus of this example thus completed, an image was displayed by causing the electron beams to collide with the fluorescent materials, thereby inducing excitation and light emission as in the example 1.

In the image forming apparatus of the present example, in a range of the high voltage Va up to 21 kV, an image of extremely high luminance and satisfactory color representation was obtained in stable manner without any discharge or leak current other than a current based on the spacer resistance and the anode voltage. This result is presumably attributable to an increase in the discharge breakdown voltage, because of an increase of the distance along the surface resulting from the formation of surface irregularities and a secondary electron emission efficiency substantially close to unity resulting from the presence of carbon layer in the recesses.

EXAMPLE 14

This example shows the preparation of the spacer of a configuration shown in FIG. 6A, in which a catalytic metal is formed in a desired pattern to selectively and partially form a carbon layer, and a carbon layer is also formed on the protruding face of the resin layer.

In this example, the process was same as that of the example 1 except for the step i, which will be explained in detail in the following.

(step i)

In this example, a small glass piece, cut and polished into a size of 4×40×0.2 mm, was washed, then aqueous solution of nickel formate was applied onto thus prepared spacer substrate by an ink jet method in stripes of a width of 50 μm so as to correspond to the pitch P=70 μm and the recess width 1=50 μm shown in FIG. 6A. Then the substrate was baked for 30 minutes at 350° C. in nitrogen atmosphere to decompose nickel format, thereby forming a stripe-shaped fine nickel metal particle layer on both surfaces of the spacer substrate. Then thus prepared spacer substrate was immersed in and lifted from polybenzimidazole varnish (PBI MR solution supplied by Toray Co.) diluted to twice volume with N,N-dimethylacetamide. Then solvent was removed by procuring for 20 minutes at 100° C. in an oven, and these steps were repeated to obtain an organic resin layer of 10 μt. Then the coating was cured by placing the coated glass piece in a clean oven with nitrogen atmosphere, raising the temperature from the room temperature to 200° C., then maintaining this temperature for 30 minutes, again raising the temperature to 300° C. and maintaining this temperature for 1 hour. Heating was further conducted for 30 minutes at 470° C. Then thus obtained spacer, on which the carbon layer 52 and the polybenzimidazole resin layer 51 were alternated in stripes, was placed in a vacuum chamber as in the example 9 and the carbon layer of the substrate was irradiated with an electron beam, emitted from an electron gun with an electron density of $10^{18}$ electrons/cm$^2$ and an acceleration energy of 50 V. Also the entire spacer surface was irradiated with an electron beam, emitted from the electron gun with an electron density of $10^{14}$ electrons/cm$^2$ and an acceleration energy of 40 V. On both end faces of the spacer, coming into contact with the face plate and the rear plate, organic resin was further carbonized by electron beam irradiation to form electrical contact layers.

In thus obtained spacer, a carbon layer 52 and a polybenzimidazole resin layer 51 were alternately repeated in stripe shape with respective widths of 50 and 20 μm, with respective thicknesses of 10 and 2 μm.

Also the sheet resistance Rs of the spacer surface was $6\times10^9\Omega/\square$.

The subsequent steps were conducted as in the example 9 to complete the image forming apparatus.

In the image forming apparatus of this example thus completed, an image was displayed by causing the electron beams to collide with the fluorescent materials, thereby inducing excitation and light emission as in the example 1.

In the image forming apparatus of the present example, in a range of the high voltage Va up to 21 kV, an image of extremely high luminance and satisfactory color representation was obtained in stable manner without any discharge or leak current other than a current based on the spacer resistance and the anode voltage, and without any significant electron beam deviation due to elimination of spacer charging by the high resistance layer provided on the spacer surface. This result is presumably attributable to an increase in the discharge breakdown voltage, because of an increase of the distance along the surface resulting from the formation of surface irregularities and a secondary electron emission efficiency substantially close to unity resulting from the presence of carbon layer in the recesses

EXAMPLE 15

Figure 11:
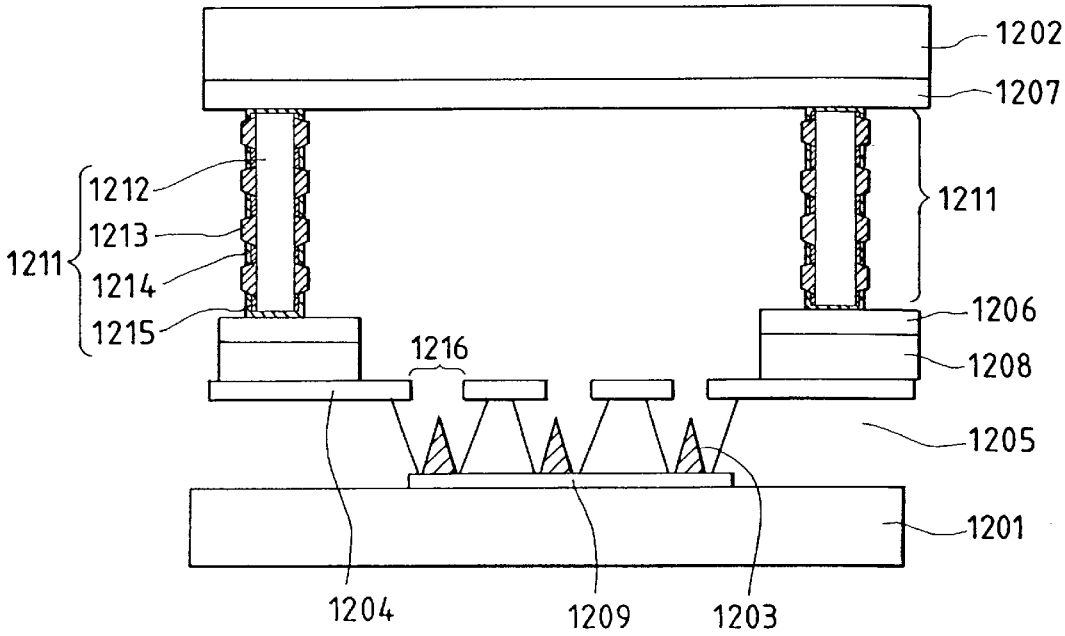
FIG. 11 is a cross-sectional view showing an image-forming apparatus using a field-emission electron emitting device according to an embodiment 15 of the present invention.
Figure 12:
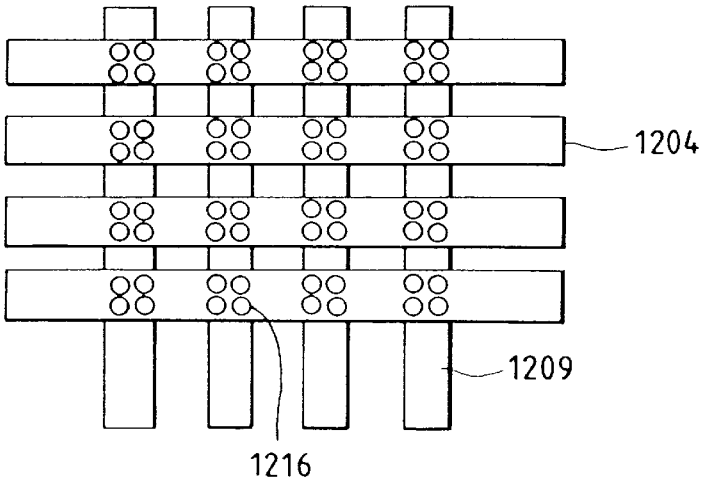
FIG. 12 is a plan view showing a rear plate of an image-forming apparatus using a field-emission electron emitting device according to an embodiment 15 of the present invention.

This example shows an image forming apparatus in which the electron emitting device is composed of a field emission device which is a cold cathode electron emitting device and the substrate of the spacer is composed of a glass rod. At first there will be explained the field emission device with reference to FIGS. 11 and 12, in which FIG. 11 is a cross-sectional view of the device. Referring to FIGS. 11 and 12, there are shown a rear plate 1201; a face plate 1202; a cathode 1203; a gate electrode 1204; an insulation layer 1205 between the gate electrode and the cathode; a converging electrode 1206; a fluorescent member and a metal back 1207; an insulation layer 1208 between the converging electrode and the gate electrode; a cathode wiring 1209; a spacer 1211; a spacer substrate 1212; an organic resin layer 1213; a carbon layer 1214 and a contact layer 1215.

FIG. 12 is a plan view of the rear plate shown in FIG. 11. In the plan view, the insulation layer 1205 between the gate electrode and the cathode, and the converging electrode 1206 are omitted for the purpose of simplicity.

The field emission device is to emit electrons from the pointed end of the cathode 1203, by the application of a strong electric field between the pointed end of the cathode 1203 and the gate electrode 1204. The gate electrode 1204 is provided with electron passing apertures 1216, for passing the electrons from plural cathodes. The electrons passing through the electron passing aperture 1216 converge by the converging electrode 1206, then are accelerated by the electric field of an anode 1207 provided on the face plate 1202 and collide with a fluorescent pixel corresponding to the cathode, thereby emitting light for display. The plural gate electrodes 1204 and the plural cathode wirings 1209 are arranged in a simple matrix shape, and a corresponding cathode is selected by an input signal and the electrons are emitted from the thus selected cathode.

The effective display area of the image forming apparatus had an aspect ratio 3:4 with a diagonal length of 10 inches. The gap between the rear plate 1201 and the face plate 1202 was 2.0 mm.

In the following there will be explained the method of preparation of the image forming apparatus of the present example.

Preparation of Rear Plate

Step 1

A soda-lime glass plate was employed as the substrate, and the cathodes, gate electrodes and wirings shown in FIGS. 11 and 12 were prepared by a known process. The cathodes were composed of molybdenum.

Step 2

Frit glass for fixing a support frame was formed by printing in a desired position.

In this manner field emission electron-emitting devices with simple matrix wirings were formed on the rear plate 1201.

Preparation of Face Plate

Step 3

On a soda-lime glass substrate, a transparent electroconductive film, fluorescent materials and a black electroconductive film were formed by printing. The internal surface of the fluorescent film was subjected to a filming treatment, and then Al was deposited by vacuum evaporation to obtain a metal back. In this manner the fluorescent materials of three primary colors, arranged in stripes, were formed on the face plate.

Preparation of Spacers

Step 4

A glass rod of a diameter of 50 μmϕ and a length of 30 cm was washed, then aqueous solution of nickel formate was applied onto the glass rod under rotation by an ink jet method in stripes of a width of 50 μm so as to correspond to the pitch P=70 μm and the recess width 1=50 μm shown in FIG. 6A. Then the glass rod was baked for 30 minutes at 350° C. in nitrogen atmosphere to decompose nickel formate, thereby forming a stripe-shaped fine nickel metal particle layer on the glass rod constituting the spacer substrate. Then thus prepared spacer substrate was immersed in and lifted from polybenzimidazole varnish (PBI MR solution supplied by Toray Co.) diluted to twice volume with N,N-dimethylacetamide. Then solvent was removed by procuring for 20 minutes at 100° C. in an oven, and these steps were repeated to obtain an organic resin layer of a desired thickness. Then the coating was cured by placing the coated glass rod in a clean oven with nitrogen atmosphere, raising the temperature from the room temperature to 200° C., then maintaining this temperature for 30 minutes, again raising the temperature to 300° C. and maintaining this temperature for 1 hour. Heating was further conducted for 30 minutes at 500° C. Then thus obtained rod-shaped spacer, on which the carbon layer 52 and the polybenzimidazole resin layer 51 are alternated in stripes, was placed in a vacuum chamber and the carbon layer of the substrate was irradiated with an electron beam, emitted from an electron gun with an electron density of $10^{18}$ electrons/cm$^2$ and an acceleration energy of 50 V. Then the entire spacer surface was irradiated with an electron beam, emitted from the electron gun with an electron density of $10^{14}$ electrons/cm$^2$ and an acceleration energy of 40 V.

In thus obtained spacer, a carbon layer 52 and a polybenzimidazole resin layer 51 were alternately repeated in stripe shape with respective widths of 50 and 20 μm, with respective thicknesses of 10 and 2 μm.

Thus prepared glass rod was cut into a length of 2 mm. On both end faces of the thus obtained spacers, coming into contact with the face plate and the rear plate, metallic Pt was formed as electrical contact layers.

The sheet resistance Rs of the spacer surface was $3\times10^9$ $\Omega/\square$.

Step 5

In positions for placing the spacers on the face plate, a mixture of Toreniece #3000 and carbon black powder (furnace black) of a particle size of 29 nm in an amount of 30 wt % with respect to the Toreniece #3000 resin content was coated with a dispenser, and the spacers prepared in the step 4 were temporarily fixed. In this operation, the spacers were supported substantially vertically by an unrepresented jig. Prebaking was conducted for 10 minutes at 100° C. while the spacers were temporarily fixed, and, after the removal of the jig for supporting the spacers, curing was conducted in a clean oven by raising the temperature from the room temperature to 300° C., and maintaining this temperature for 1 hour. In this manner the spacers 11 were fixed at the desired positions on the rear plate 1. The support frame was adhered to the face plate on which the plurality of spacers were fixed.

Then the face plate on which the spacers and the support frame and the rear plate were adhered was sealed by adhesion under pressure. In the sealing operation mentioned above, sufficient registration was executed since, in case of a color image, the fluorescent materials of respective colors have to be aligned with the electron emitting devices.

Step 6

The atmosphere in thus completed glass container was evacuated by a vacuum pump through an evacuating pipe (not shown), and, after a sufficient vacuum level was reached, baking was conducted for 3 hours at 250° C. and under continuous evacuation.

Step 7

Then the envelope was evacuated to about $10^{-8}$ Torr at room temperature, and the envelope was sealed by fusing the unrepresented evaluating pipe with a burner.

Finally, after the evacuation and the sealing, the getter treatment was conducted with high-frequency heating in order to maintain the vacuum level after sealing.

In the image forming apparatus of this example thus completed, an image was displayed by causing the electron beams to collide with the fluorescent material, thereby inducing excitation and light emission as in the example 1.

In the image forming apparatus of the present example, in a range of the high voltage Va up to 13 kV, an image of extremely high luminance and satisfactory color representation was obtained in stable manner, without any discharge or leak current other than a current based on the spacer resistance and the anode voltage. This result is presumably attributable to an increase in the discharge breakdown voltage, because of an increase of the distance along the surface resulting from the formation of surface irregularities and a secondary electron emission efficiency substantially close to unity resulting from the presence of carbon layer in the recesses.

EXAMPLE 16

In this example, the spacer was modified in shape from that in the foregoing examples 5, 8 and 11 but the preparing method is similar to that in these examples.

The image forming apparatus had an effective image display area of 125×125 mm for color display with three primary colors of red, green and blue, with a pixel size of 150 μm×3 (R, G, B)×450 μm. In this example, the spacer substrate had a dimension of 3×140×0.1 mm.

In this example, the process up to the step i was same as in the foregoing examples and will not, therefore, be explained. In the following there will be explained the preparation of the image forming apparatus after the step j, with reference to FIGS. 16A to 16E, which are cross-sectional views of the image forming apparatus shown in FIG. 9. In these drawings, there are shown an adhesive 161 for the spacer; and frit glass 162. In FIGS. 16A to 16E, components same as those in FIGS. 1, 2, 8 and 9 are represented by same numbers.

(Step j)

Figure 16A:
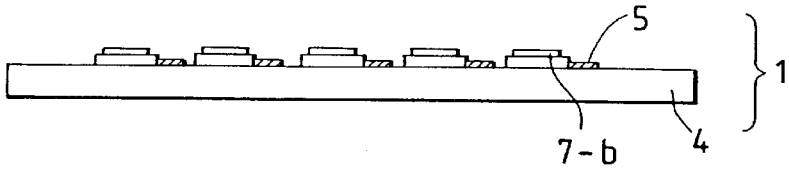
FIGS. 16A, 16B, 16C, 16D, and 16E are views explaining a manufacturing method of an image-forming apparatus according to the present invention.
Figure 16B:
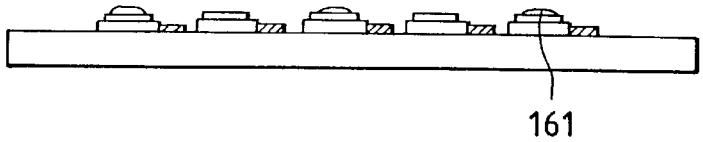

(Step j-1): In positions for placing the spacers on the upper wiring 7*b* of the rear plate 1 after the step h (FIG. 16A), a mixture of the PBI MR solution and natural graphite powder of a particle size of 100 nm in an amount of 30 wt % with respect to the resin content of the PBI MR solution was coated with a dispenser (FIG. 16B).

Figure 16C:
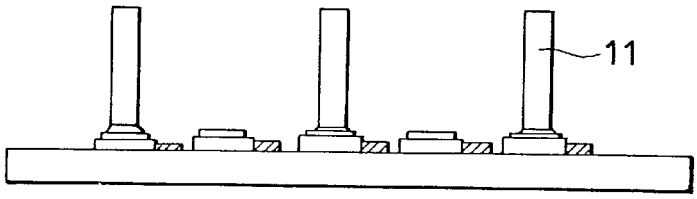

(Step j-2): The spacers 11 prepared in the step i were temporarily fixed on the PBI resin 161 mentioned above. In this operation, the spacers 11 were supported substantially vertically by an unrepresented jig. The resin was prebaked for 10 minutes at 100° C. while the spacers were temporarily fixed, and, after the removal of the jig for supporting the spacers, it was cured in a clean oven by raising the temperature from the room temperature to 200° C., then maintaining the temperature at 200° C. for 30 minutes, further raising the temperature to 300° C. and maintaining the temperature at 300° C. for 1 hour. In this manner the spacers 11 were fixed at the desired positions on the rear plate 1 (FIG. 16C).

(Step k)

Figure 16D:
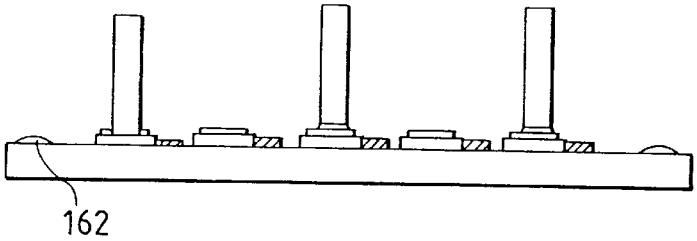

(Step k-1): On the rear plate 1 on which a plurality of spacers 11 were fixed in the above-explained manner, there was positioned a support frame 3. In this operation, frit glass 162 was coated in advance on the adhering portion between the rear plate 1 and the support frame 3. A face plate 2 (prepared by forming a fluorescent film 10 and a metal back 91 on the internal face of a glass substrate 8) was placed on the support frame 3 and the spacers 11, and frit glass and a mixture of the PBI MR solution and natural graphite powder of a particle size of 100 nm in an amount of 30 wt % with respect to the resin content of the PBI MR solution were respectively coated in advance on the adhering portion between the face plate 2 and the support frame 3 and that between the face plate 2 and the spacers 11 (FIG. 16D).

Figure 16E:
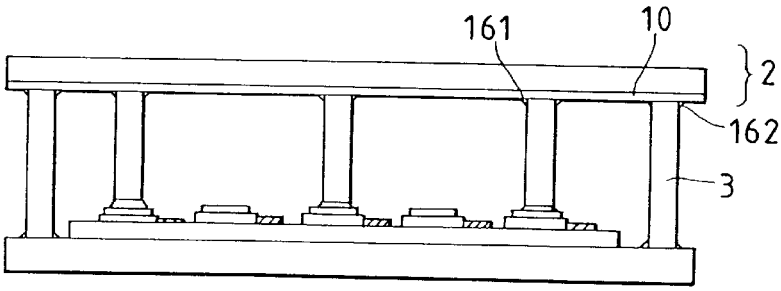

(Step k-2): The adhered composite of the rear plate 1, the support frame 3 and the face plate 2 was sealed, in the air, by treating for 10 minutes at 100° C., then raising the temperature to 200° C., maintaining this temperature for 30 minutes, then raising the temperature to 300° C., maintaining this temperature for 1 hour and baking the composite for 10 minutes at 400° C. In the sealing operation mentioned above, sufficient registration was executed since, in case of a color image, the fluorescent materials of respective colors have to be aligned with the electron emitting devices (FIG. 16E).

The atmosphere in thus completed glass container was evacuated by a vacuum pump through an evacuating pipe, and, after a sufficient vacuum level was reached, the energization forming process and the activation process were conducted in the same manner as in the example 1.

Then, after the evacuation and the sealing, the getter treatment was conducted with high-frequency heating.

In the following there will be explained, with reference to FIG. 17, a configuration of the drive circuit for executing television display based on the NTSC television signal, on thus completed image forming apparatus of the present invention.

Figure 17:
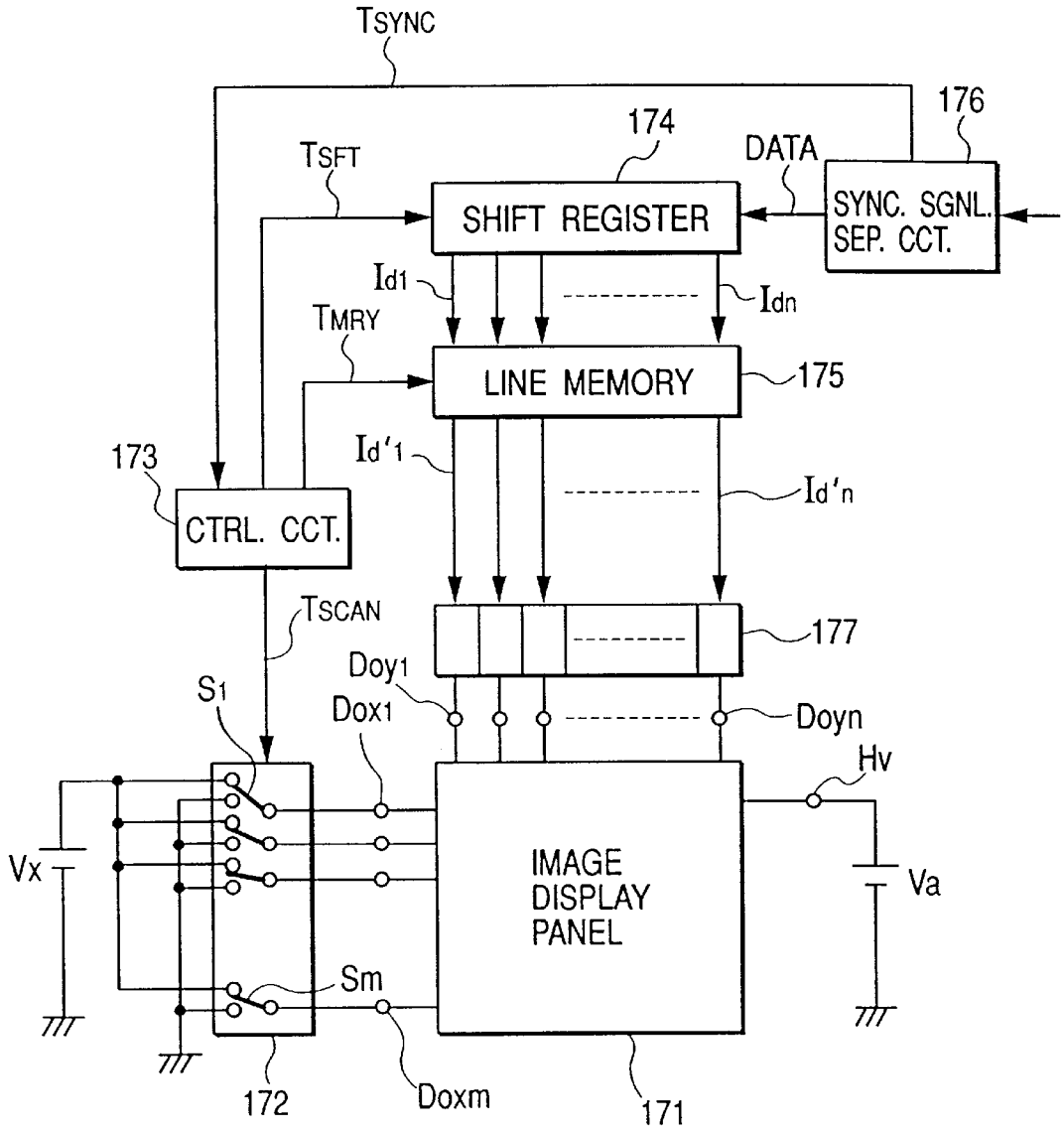
FIG. 17 is an example of a drive block diagram of an image-forming apparatus according to the present invention.

In FIG. 17, there are shown an image display panel 171; a scanning circuit 172; a control circuit 173; a shift register 174; a line memory 175; a synchronization signal separation circuit 176; a modulation signal generator 177; and DC voltage sources Vs, Va.

The display panel 171 is connected, through terminals $D_{oxl}$–$D_{osm}$ and terminals $D_{oyl}$–$D_{oyn}$, to an external circuit. The terminals $D_{oxl}$–$D_{oxm}$ receive a scanning signal for driving the electron sources provided in the display panel, namely driving the group of surface conduction electron-emitting devices arranged in a matrix of M rows and N columns in succession by a row (N devices) at a time.

The terminals $D_{oyl}$–$D_{oyn}$ receive modulation signals for controlling the output electron beams of the surface conduction electron-emitting devices of a row selected by the above-mentioned scanning signal. A high voltage terminal Hv receives, from the DC voltage source Va, a DC voltage, for example 10 kV, for providing the electron beams emitted from the surface conduction electron-emitting devices with an energy for exciting the fluorescent material.

The scanning circuit 172 is provided therein with M switching elements (schematically represented by Sl–Sm), each of which selects either the output voltage of the DC voltage source Vx or 0 V (ground level) and is electrically connected to one of the terminals $D_{oxl}$–$D_{oxm}$ of the display panel 171. The switching elements Sl–Sm are operated according to a control signal $T_{scan}$ outputted from the control circuit 173, and can be composed, for example, of FET's or similar switching elements.

The DC voltage source Vx is so constructed, based on the characteristics (electron-emitting threshold voltage) of the surface conduction electron-emitting devices in the present example, as to output such a predetermined voltage that the driving voltage, applied to the non-scanned device, is less than the electron emitting threshold voltage.

The control circuit 173 has a function of coordinating the functions of various units so as to provide appropriate display based on the externally entered image signal. More specifically, the control circuit 173 generates control signals $T_{scan}$, $T_{sft}$ and $T_{mry}$, based on a synchronization signal $T_{sync}$ supplied from the synchronization signal separation circuit 176.

The synchronization signal separation circuit 176, for separating a synchronization signal component and a luminance signal component from the television signal of NTSC format entered from the outside, can be composed of general frequency separation (filter) circuits. The synchronization signal separated by the synchronization signal separation circuit 176 is composed of a vertical synchronization signal and a horizontal synchronization signal, but is illustrated as $T_{sync}$ for the purpose of simplicity. The image luminance signal component separated from the above-mentioned television signal is represented as DATA signal for the purpose of simplicity. This DATA signal is entered into the shift register 174.

The shift register 174 executes serial/parallel conversion of the time-sequentially entered DATA signal for each line of the image, and functions according to the control signal $T_{sft}$ supplied from the control circuit 173. (Thus the control signal $T_{sft}$ may be regarded as the shift clock for the shift register 174.) The serial/parallel converted data of a line of the image (corresponding to the drive data for N electron-emitting devices) are released as N parallel signals $I_{dl}$–$I_{dn}$ from the shift register 174.

The line memory 175, for memorizing the data of a line of the image for a necessary period, suitably stores the contents of the signals $I_{dl}$–$I_{dn}$ according to the control signal $T_{mry}$ supplied from the control circuit 173. The stored contents are outputted as signals $I'_{dl}$–$I'_{dn}$, which are entered into the modulation signal generator 177.

The modulation signal generator 177 is a signal source for appropriately modulating the surface conduction electron-emitting devices respectively according to the image data $I'_{dl}$–$I'_{dn}$, and its output signals are applied to the surface conduction electron-emitting devices of the display panel 171 through the terminals $D_{oyl}$–$D_{oyn}$.

In this example, the modulation is achieved by pulse width modulation. For realizing such pulse width modulation, the modulation signal generator 177 can be composed of a pulse width modulation circuit which generates voltage pulses of a constant wave height and suitably modulates the width of the voltage pulse according to the input data.

The shift register 174 and the line memory 175 can be of digital type or analog type, since these components need only to execute the serial/parallel conversion and storage of the image signal at a predetermined speed.

The electron emission is induced by the voltage application, by the above-explained drive circuit, to the electron emitting devices of the display panel Ad through the terminals $D_{oxl}$–$D_{oxm}$ and $D_{oyl}$–$D_{oyn}$ provided outside the envelope. The high voltage is applied to the metal back 149 through the high voltage terminal Hv to accelerate the electron beam. The accelerated electrons collide with the fluorescent film 148, thereby inducing light emission and forming an image.

In each of the above-explained image forming apparatus of the present invention, a television image was displayed in response to the entry of an NTSC signal.

In any of the image forming apparatus of the foregoing examples, the discharge or the leak current was not observed within a range of the high voltage Va up to 10 kV. Slight discharge was observed in an image forming apparatus provided with the spacers similar to those in the example 8, but image forming apparatus provided with the spacers similar to those in the examples 5 and 11 provided images of extremely high luminance and satisfactory color representation in stable manner, without any discharge or leak current. Also the influence of charging was not observed. As explained in the foregoing, the image forming apparatus of the present example was prepared with relatively low cost, because the process for preparing the spacer was simplified.

EFFECT OF THE INVENTION

As explained in the foregoing, the present invention can provide an image forming apparatus capable of maintaining a satisfactory image with a high luminance and a high color saturation over a prolonged time, thereby providing a high-quality flat panel image forming apparatus.

What is claimed is:

1. A spacer for an image forming apparatus comprising:

a spacer base member, the surface of which comprises a plurality of concavities forming a concave and convex surface; and a conductive film covering the concave and convex surface of said spacer base member so that the surface of said spacer covered by the conductive film has a plurality of concavities forming a concave and convex surface, wherein the resistance of said conductive film is in the range of $10^9\Omega/\square$ to $10^{12}\Omega/\square$, and $l \geqq p/2$, wherein l is a length of each concavity and p is a pitch of the concave and convex surface.

2. A spacer for an image forming apparatus comprising:

a spacer base member, the surface of which comprises a plurality of concavities forming a concave and convex surface; and a conductive film covering the concave and convex surface of said spacer base member so that the surface of said spacer covered by the conductive film has a plurality of concavities forming a concave and convex surface, wherein the resistance of said conductive film is in the range of $10^9\Omega/\square$ to $10^{12}\Omega/\square$, and $t \geqq 0.2\,l$, and $l \geqq p/2$, wherein t is a depth of each concavity, l is a length of each concavity and p is a pitch of the concave and convex surface.

3. A spacer for an image forming apparatus comprising:

a spacer base member, the surface of which comprises a plurality of concavities forming a concave and convex surface; and a film covering the concave and convex surface of said spacer base member so that the surface of said spacer covered by the film has a plurality of concavities forming a concave and convex surface, wherein said film comprises a material which has a smaller secondary electron emission coefficient than that of a material comprising said spacer base member and is electroconductive, wherein the resistance of said conductive film is in the range of $10^9\Omega/\square$ to $10^{12}\Omega/\square$, and $l \geqq p/2$, wherein l is a length of each concavity and p is a pitch of the concave and convex surface.

4. A spacer for an image forming apparatus comprising:

a spacer base member, the surface of which comprises a plurality of concavities forming a concave and convex surface; and a film covering the concave and convex surface of said spacer base member so that the surface of said spacer covered by the film has a plurality of concavities forming a concave and convex surface, wherein said film comprises a material which has a smaller secondary electron emission coefficient than that of a material comprising said spacer base member and is electroconductive, wherein the resistance of said conductive film is in the range of $10^9\Omega/\square$ to $10^{12}\Omega/\square$, and $t \geqq 0.2\,l$, and $l \geqq p/2$, wherein t is a depth of each concavity, l is a length of each concavity and p is a pitch of the concave and convex surface.

5. An image forming apparatus comprising:

a rear plate on which an electron-emitting device is disposed;

a face plate opposing said rear plate and provided with an image forming member; and a spacer disposed between said rear plate and said face plate, said spacer comprising a spacer base member, the surface of which comprises a plurality of concavities forming a concave and convex surface, and a conductive film covering the concave and convex surface of said spacer base member so that the surface of said spacer covered by said conductive film has a plurality of concavities forming a concave and convex surface, wherein the resistance of said conductive film is in the range of $10^9\Omega/\square$ to $10^{12}\Omega/\square$, and $l \geqq p/2$, wherein l is a length of each concavity and p is a pitch of the concave and convex surface.

6. An image forming apparatus comprising:

a rear plate on which an electron-emitting device is disposed;

a face plate opposing said rear plate and provided with an image forming member; and a spacer disposed between said rear plate and said face plate, said spacer comprising a spacer base member, the surface of which comprises a plurality of concavities forming a concave and convex surface, and a conductive film covering the concave and convex surface of said spacer base member so that the surface of said spacer covered by said conductive film has a plurality of concavities forming a concave and convex surface;

wherein the resistance of said conductive film is in the range of $10^9\Omega/\square$ to $10^{12}\Omega/\square$, and $t \geqq 0.2\,l$, and $l \geqq p/2$, wherein t is a depth of each concavity, l is a length of each concavity and p is a pitch of the concave and convex surface.

7. An image forming apparatus comprising:

a rear plate on which an electron-emitting device is disposed;

a face plate opposing said rear plate and provided with an image forming member; and a spacer disposed between said rear plate and said face plate, said spacer comprising a spacer base member, the surface of which comprises a plurality of concavities forming a concave and convex surface, and a film covering the concave and convex surface of said spacer base member so that the surface of said spacer covered by the film has a plurality of concavities forming a concave and convex surface, wherein said film comprises a material which has a smaller secondary electron emission coefficient than that of a material comprising said spacer base member and is electroconductive, wherein the resistance of said conductive film is in the range of $10^9\Omega/\square$ to $10^{12}\Omega/\square$, and $l \geqq p/2$, wherein l is a length of each concavity and p is a pitch of the concave and convex surface.

8. An image forming apparatus comprising:

a rear plate on which an electron-emitting device is disposed;

a face plate opposing said rear plate and provided with an image forming member; and a spacer disposed between said rear plate and said face plate, said spacer comprising a spacer base member, the surface of which comprises a plurality of concavities forming a concave and convex surface, and a film covering the concave and convex surface of said spacer base member so that the surface of said spacer covered by said film has a plurality of concavities forming a concave and convex surface, wherein said film comprises a material which has a smaller secondary electron emission coefficient than that of a material comprising said spacer base member and is electroconductive, wherein the resistance of said conductive film is in the range of $10^9\Omega/\square$ to $10^{12}\Omega/\square$, and $t \geqq 0.2\,l$, and $l \geqq p/2$, wherein t is depth of each concavity, l is a length of each concavity and p is a pitch of the concave and convex surface.

* * * * *

UNITED STATES PATENT AND TRADEMARK OFFICE

CERTIFICATE OF CORRECTION

PATENT NO. : 6,353,280 B1
DATED : March 5, 2002
INVENTOR(S) : Masaaki Shibata et al.

It is certified that error appears in the above-identified patent and that said Letters Patent is hereby corrected as shown below:

Column 2,
Line 30, “place.” should read -- plate. --.

Column 4,
Line 48, “between-the” should read -- between the --.

Column 6,
Line 5, “area),” should read -- area) --.

Column 15,
Line 31, “of” should read -- on --.

Column 19,
Line 30, “Reference” should read -- Reference t0 --.
Line 47, “1>P/2” should read -- 1≥P/2 --.

Column 20,
Line 5, “P; l,” should read -- P, 1, --.

Column 34,
Line 59, “florescent” should read -- fluorescent --.

Column 36,
Line 64, “florescent” should read -- fluorescent --.

Column 41,
Line 19, “the-discharge” should read -- the discharge --.

UNITED STATES PATENT AND TRADEMARK OFFICE

CERTIFICATE OF CORRECTION

PATENT NO. : 6,353,280 B1
DATED : March 5, 2002
INVENTOR(S) : Masaaki Shibata et al.

It is certified that error appears in the above-identified patent and that said Letters Patent is hereby corrected as shown below:

Column 48,
Line 18, "Ad" should be deleted.

Signed and Sealed this

Fourteenth Day of January, 2003

JAMES E. ROGAN
*Director of the United States Patent and Trademark Office*